US008446442B2

(12) United States Patent
Yamamoto

(10) Patent No.: US 8,446,442 B2
(45) Date of Patent: May 21, 2013

(54) THERMAL PRINT HEAD AND METHOD OF MANUFACTURING THE SAME

(75) Inventor: Masaya Yamamoto, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 15 days.

(21) Appl. No.: 13/300,782

(22) Filed: Nov. 21, 2011

(65) Prior Publication Data

US 2012/0127254 A1 May 24, 2012

(30) Foreign Application Priority Data

Nov. 19, 2010 (JP) ..... 2010-259265
Nov. 19, 2010 (JP) ..... 2010-259266
Nov. 19, 2010 (JP) ..... 2010-259267
Nov. 19, 2010 (JP) ..... 2010-259268

(51) Int. Cl.
*B41J 2/34* (2006.01)

(52) U.S. Cl.
USPC ..... 347/200

(58) Field of Classification Search
USPC ..... 347/200–211
See application file for complete search history.

(56) References Cited

U.S. PATENT DOCUMENTS 5,278,580 A * 1/1994 Nishikawa et al. ..... 347/114
6,151,054 A * 11/2000 Shimizu ..... 347/204
6,335,750 B2 * 1/2002 Horiuchi et al. ..... 347/200
2010/0053294 A1 * 3/2010 Fukumoto ..... 347/200

FOREIGN PATENT DOCUMENTS

WO 2005/120841 12/2005

* cited by examiner

*Primary Examiner* — Kristal Feggins
(74) *Attorney, Agent, or Firm* — Hamre, Schumann, Mueller & Larson, P.C.

(57) ABSTRACT

A thermal print head includes a substrate, a glaze layer formed on the substrate and provided with a heating resistor support portion extending in a primary scanning direction and having an arc-like cross-sectional shape when seen in a direction perpendicular to the primary scanning direction, an electrode layer including a plurality of individual electrodes, each provided with a first strip-shaped portion arranged along the primary scanning direction, each of the first strip-shaped portions formed on the heating resistor support portion, and a common electrode provided with a plurality of second strip-shaped portions arranged along the primary scanning direction, each of the second strip-shaped portions formed on the heating resistor support portion; and a resistor layer including heating portions heated by applying an electric current from the electrode layer and electrode covering portions each configured to cover a gap between the first and second strip-shaped portions.

23 Claims, 37 Drawing Sheets

THERMAL PRINT HEAD AND METHOD OF MANUFACTURING THE SAME

CROSS-REFERENCE TO RELATED APPLICATIONS

This application is based upon and claims the benefit of priority from Japanese Patent Application Nos. 2010-259265, 2010-259266, 2010-259267 and 2010-259268; filed on Nov. 19, 2010, respectively, the entire contents of which are incorporated herein by reference.

TECHNICAL FIELD

The present disclosure relates to a thermal print head and a method of manufacturing the same.

BACKGROUND

Referring to FIG. 37, one example of conventional thermal print heads is illustrated (see, e.g., Japanese Patent Laid-Open Re-Publication No. 2005-120841). A thermal print head 900 shown in FIG. 37 includes a ceramic substrate 91 and a wiring substrate 92. A glaze layer 93 is formed in the ceramic substrate 91. The glaze layer 93 is made of, e.g., glass, and has an arc-like cross-sectional shape when seen in a direction perpendicular to a primary scanning direction. An electrode layer 94 is also formed in the ceramic substrate 91. The electrode layer 94 is mainly composed of, e.g., Au, and includes a plurality of individual electrodes 941 and a common electrode 942. A resistor layer 95 and a protective layer 96 are formed one above another on the electrode layer 94. The resistor layer 95 is formed to straddle the individual electrodes 941 and the common electrode 942. The protective layer 96 is formed to protect the electrode layer 94 and the resistor layer 95 and is made of, e.g., glass. A drive IC 97 is mounted to one end of the ceramic substrate 91 in a secondary scanning direction. The drive IC 97 functions to partially apply an electric current to the resistor layer 95 through the individual electrodes 941. The drive IC 97 is connected to the individual electrodes 941 and the wiring substrate 92 by wires 98.

A thermal paper as a print target is pressed against the resistor layer 95 through the protective layer 96. This pressing operation is performed by a platen roller (not shown) provided in a printer incorporating the thermal print head 900. If the pressing force applied by the platen roller reaches the area where the individual electrodes 941 and the common electrode 942 exist, it is likely that the portion of the resistor layer 95 covering the individual electrodes 941 and the common electrode 942 may suffer from damage. Japanese Patent Laid-Open Re-Publication No. 2005-120841 discloses a configuration in which the individual electrodes 941 and the common electrode 942 are sunk with respect to the glaze layer 93. However, it becomes difficult to sink the individual electrodes 941 and the common electrode 942 as the glaze layer 93 grows thinner with the reduction in the thickness of the thermal print head 900. Under these circumstances, it is impossible to avoid damage to the resistor layer 95.

SUMMARY

In view of the problems noted above, the present disclosure provides a thermal print head capable of avoiding damage to a resistor layer and a method of manufacturing the same.

A thermal print head according to one aspect of the present disclosure includes: a substrate; a glaze layer formed on the substrate and provided with a heating resistor support portion extending in a primary scanning direction and having an arc-like cross-sectional shape when seen in a direction perpendicular to the primary scanning direction; an electrode layer including a plurality of individual electrodes, each provided with a first strip-shaped portion arranged along the primary scanning direction, each of the first strip-shaped portions formed on the heating resistor support portion, and a common electrode provided with a plurality of second strip-shaped portions arranged along the primary scanning direction, each of the second strip-shaped portions formed on the heating resistor support portion; and a resistor layer including heating portions heated by applying an electric current from the electrode layer and electrode covering portions each configured to cover a gap between the first and second strip-shaped portions, each of the first and second strip-shaped portions including a normal thickness portion and a reduced thickness portion thinner than the normal thickness portion, the reduced thickness portion positioned near the gap.

In one embodiment of the present disclosure, the reduced thickness portion may be sunk with respect to the heating resistor support portion.

In another embodiment of the present disclosure, the electrode layer may include a main Au layer having a lower layer and an upper layer formed on the lower layer, the normal thickness portion formed of the lower layer and the upper layer, the reduced thickness portion formed of the lower layer.

In yet another embodiment of the present disclosure, the electrode layer may include a main Au layer having a lower layer and an upper layer formed on the lower layer, the normal thickness portion formed of the lower layer and the upper layer, the reduced thickness portion formed of the upper layer.

In yet another embodiment of the present disclosure, the electrode layer may include: a plurality of relay electrodes electrically interposed between the plurality of the individual electrodes and the common electrode.

In yet another embodiment of the present disclosure, each of the relay electrodes may include: a pair of third strip-shaped portions arranged along the primary scanning direction, each of the third strip-shaped portions opposing the first and second strip-shaped portions with a gap and extending in a secondary scanning direction, and a connecting portion interconnecting two strip-shaped portions of the pair of third strip-shaped portions.

In yet another embodiment of the present disclosure, the common electrode may include a branch portion joined to the two strip-shaped portions of second strip-shaped portions.

In yet another embodiment of the present disclosure, the common electrode may include a connecting portion interconnecting the second strip-shaped portions.

In yet another embodiment of the present disclosure, the thermal print head may further include: an Ag layer overlapping with the connecting portion; and an Ag protective layer covering the Ag layer.

In yet another embodiment of the present disclosure, the Ag protective layer may be made of glass.

In yet another embodiment of the present disclosure, the thermal print head may further include: a drive IC selectively providing the electric current to the resistor layer.

In yet another embodiment of the present disclosure, the common electrode may include a base portion spaced apart from the heating resistor support portion farther than the individual electrodes in the secondary scanning direction, the base portion configured to support a drive IC for selectively applying the electric current to the individual electrodes.

In yet another embodiment of the present disclosure, the thermal print head may further include: a resin layer interposed between the drive IC and the base portion.

In yet another embodiment of the present disclosure, the substrate may be made of ceramic.

In yet another embodiment of the present disclosure, the thermal print head may further include: a heat radiating plate made of metal and attached to the substrate.

A method of manufacturing a thermal print head according to another aspect of the present disclosure includes: forming a glaze layer on a substrate, the glaze layer provided with a heating resistor support portion extending in a primary scanning direction and having an arc-like cross-sectional shape when seen in a direction perpendicular to the primary scanning direction; forming an electrode layer including a plurality of individual electrodes, each provided with first strip-shaped portions arranged along the primary scanning direction, each of the first strip-shaped portions formed on the heating resistor support portion, and a common electrode provided with a plurality of second strip-shaped portions arranged along the primary scanning direction, each of the second strip-shaped portions formed on the heating resistor support portion; and forming a resistor layer including heating portions heated by applying an electric current from the electrode layer and electrode covering portions each configured to cover a gap between each of the first and second strip-shaped portions, each of the first and second strip-shaped portions being formed, when forming the electrode layer, to include a normal thickness portion and a reduced thickness portion thinner than the normal thickness portion, the reduced thickness portion positioned near the gap.

In another embodiment of the present disclosure, the method may further include: after forming the electrode layer and before forming the resistor layer, sinking the reduced thickness portion with respect to the heating resistor support portion by heating the heating resistor support portion.

In another embodiment of the present disclosure, forming the electrode layer may include forming a main Au layer having a lower layer and an upper layer formed on the lower layer, the normal thickness portion formed of the lower layer and the upper layer, the reduced thickness portion formed of the lower layer.

In another embodiment of the present disclosure, forming the electrode layer may include forming a main Au layer having a lower layer and an upper layer formed on the lower layer, the normal thickness portion formed of the lower layer and the upper layer, the reduced thickness portion formed of the upper layer.

In another embodiment of the present disclosure, forming the electrode layer may include printing paste containing Au and then sintering the paste.

In another embodiment of the present disclosure, forming the resistor layer may be performed by a sputtering method or a CVD method.

In another embodiment of the present disclosure, forming the electrode layer may include forming the common electrode having a connecting portion interconnecting the second strip-shaped portions. The method may further include: after forming the electrode layer and before forming the resistor layer, forming an Ag layer by printing Ag paste to overlap with the connecting portion and then sintering the Ag paste; and, after forming the Ag layer and before forming the resistor layer, forming an Ag protective layer by printing glass paste to cover the Ag layer and then sintering the glass paste.

In another embodiment of the present disclosure, at least one of sintering the Ag paste and sintering the glass paste may be combined with sinking the strip-shaped portions with respect to the heating resistor support portion.

Other features and advantages of the present disclosure will become more apparent from the detailed description made in conjunction with the accompanying drawings.

DETAILED DESCRIPTION

Certain preferred embodiments will now be described in detail with reference to the drawings.

Figure 1:
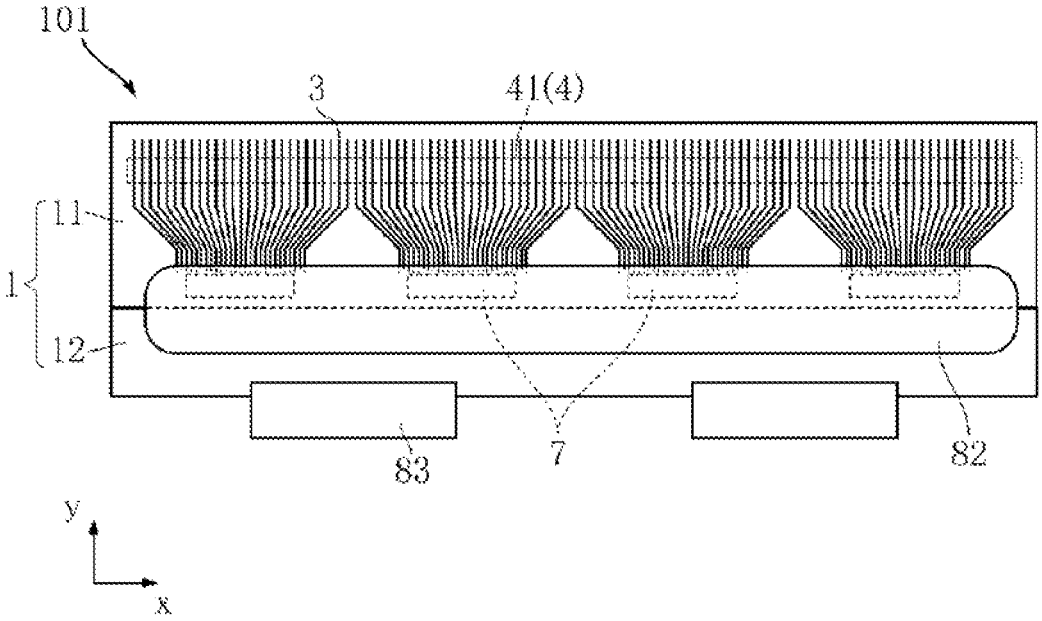
FIG. 1 is a plan view showing a thermal print head according to a first embodiment of the present disclosure.
Figure 2:
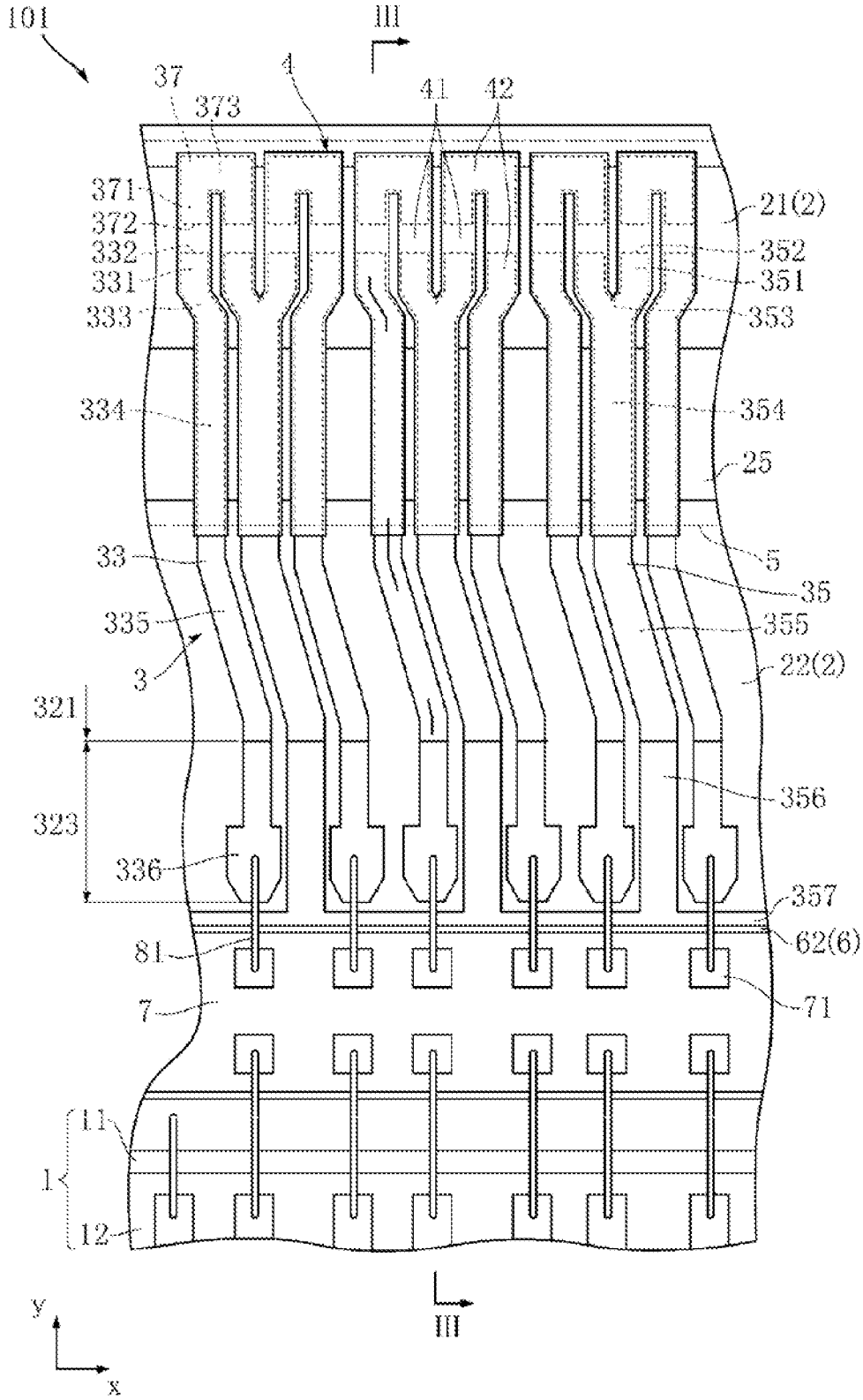
FIG. 2 is a plan view of Major portions of the thermal print head shown in FIG. 1.

FIGS. 1 through 5 show a thermal print head according to a first embodiment of the present disclosure. The thermal print head 101 of the present embodiment includes a support unit 1, a glaze layer 2, an electrode layer 3, a resistor layer 4, a protective layer 5, a resin layer 6, a drive IC 7 and an encapsulation resin 82. The thermal print head 101 is incorporated into a printer for printing e.g., a barcode sheet or a receipt on thermal paper. For the sake of understanding, the protective layer 5 and the resin layer 6 are omitted in FIG. 1. In FIG. 2, certain portions of the resin layer 6 and the encapsulation resin 82 are omitted with the protective layer 5 indicated by two-dot chain lines.

Figure 3:
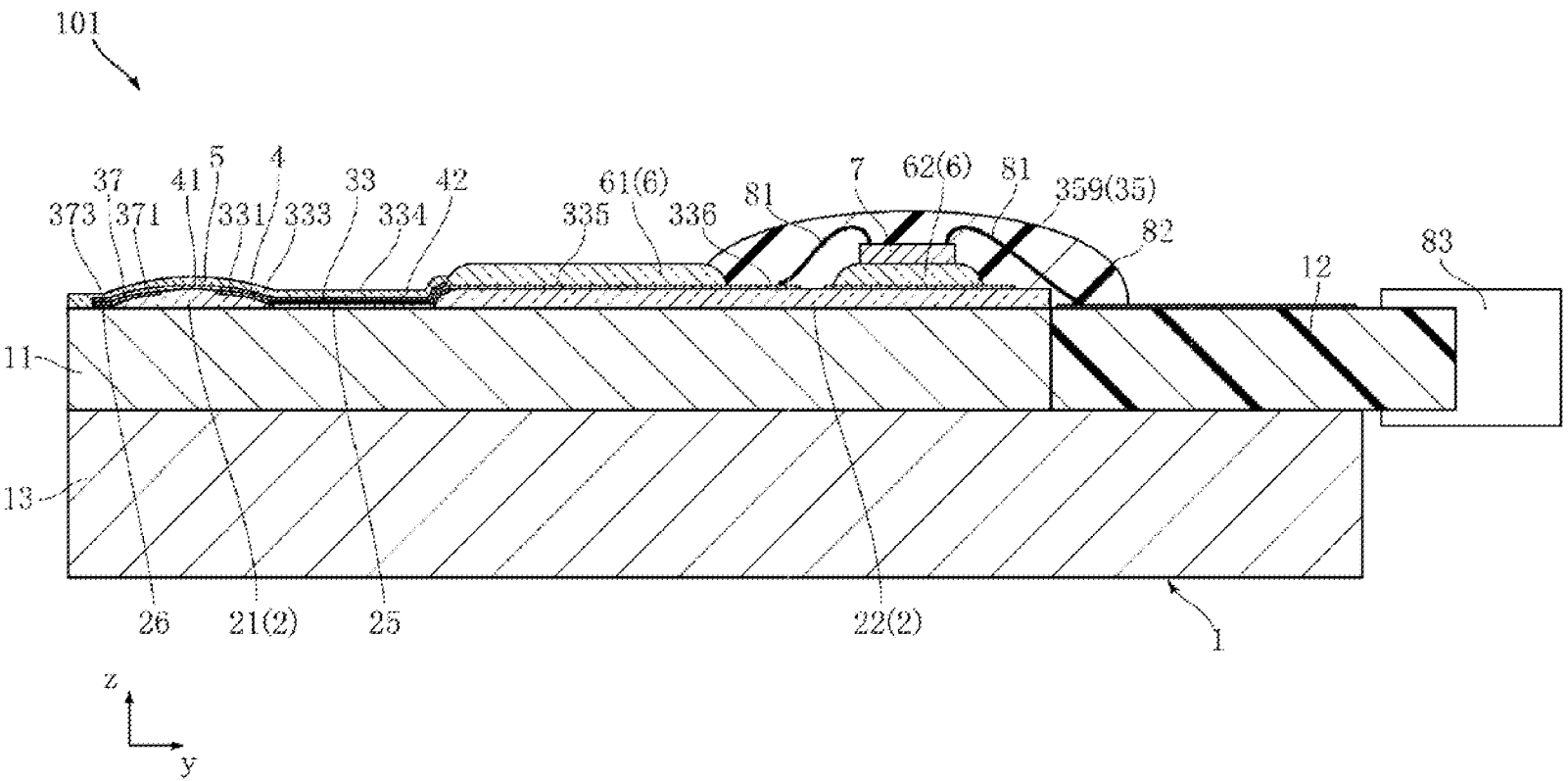
FIG. 3 is a section view taken along line III-III in FIG. 2.

The support unit 1 forms a base of the thermal print head 101 and includes a ceramic substrate 11, a wiring substrate 12 and a heat radiating plate 13. The ceramic substrate 11 is made of, e.g., ceramic such as $Al_2O_3$, and has a thickness of, e.g., about 0.6 to 1.0 mm. As shown in FIG. 1, the ceramic substrate 11 is formed into an elongated rectangular shape extending in a primary scanning direction x. The wiring substrate 12 has a structure in which a base layer made of, e.g., a glass epoxy resin, and a wiring layer made of, e.g., Cu, are laminated one above another. As shown in FIG. 3, a connector 83 for connecting the thermal print head 101 to the printer is attached to the wiring substrate 12. The heat radiating plate 13 serves to radiate heat from the ceramic substrate 11 and is made of metal, e.g., Al.

Figure 4:
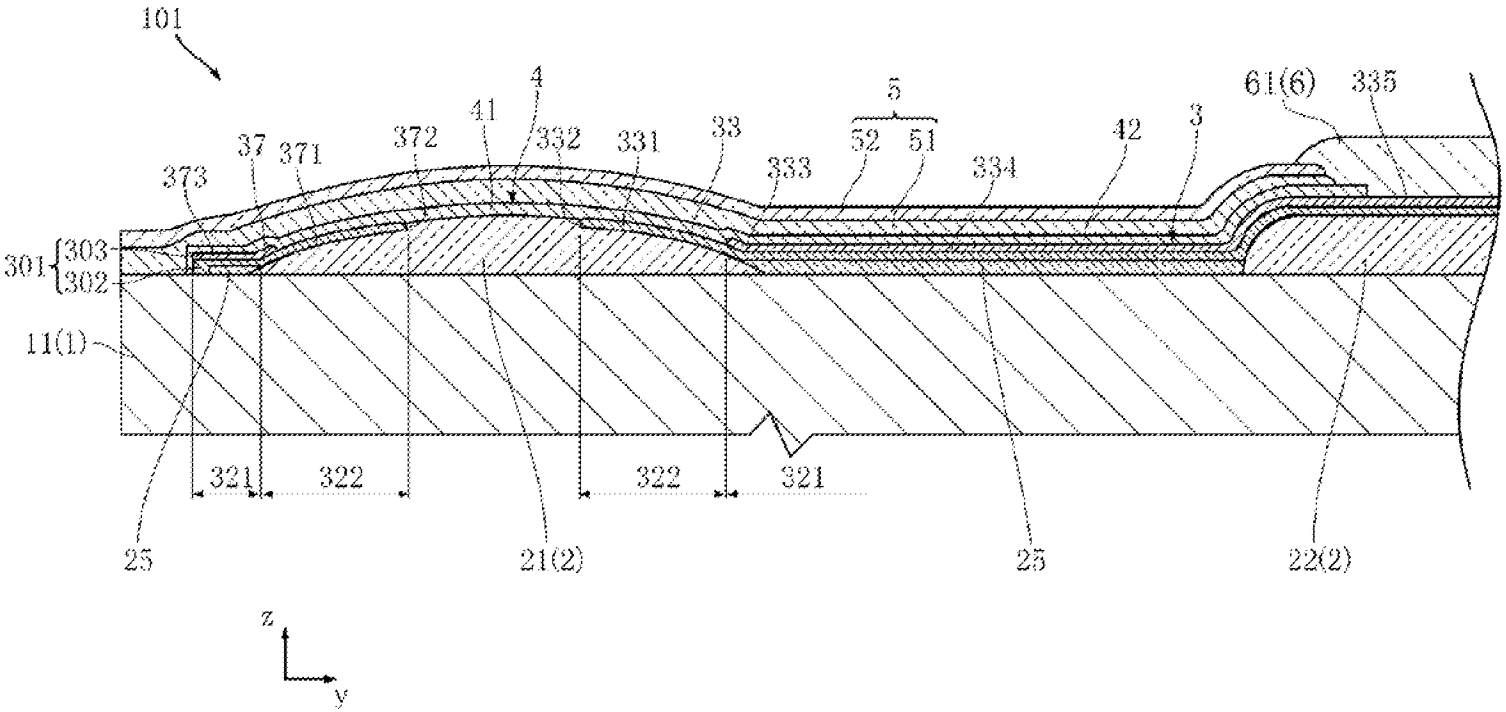
FIG. 4 is a section view of major portions taken along line III-III in FIG. 2.

The glaze layer 2 is formed on the ceramic substrate 11 and is made of a glass material, e.g., amorphous glass. The glass material has a softening point of, e.g., 800 to 850 degrees C. The glaze layer 2 includes a heating resistor support portion 21 and an IC electrode support portion 22. The heating resistor support portion 21 extends in the primary scanning direction x as shown in FIG. 2 and has an arc-like cross-sectional shape on a y-z plane containing a secondary scanning direction y and a thickness direction z as shown in FIGS. 3 and 4. The heating resistor support portion 21 is sized such that the dimension thereof in the secondary scanning direction y is, e.g., about 700 μm, and the dimension thereof in the thickness direction z is, e.g., about 18 to 50 μm. The heating resistor support portion 21 is provided to press the heating area of the resistor layer 4 against a thermal paper as a print target. The IC electrode support portion 22 is provided in a position spaced apart from the heating resistor support portion 21 in the secondary scanning direction y. The IC electrode support portion 22 supports a portion of the electrode layer 3 and the drive IC 7. The IC electrode support portion 22 has a thickness of, e.g., about 1.7 to 1.8 μm.

The area of the ceramic substrate 11 interposed between the heating resistor support portion 21 and the IC electrode support portion 22 is covered with a glass layer 25. The glass layer 25 has a softening point of, e.g., 680 degrees C., and is made of glass whose softening point is lower than the softening point of the glass making up the glaze layer 2. The glass layer 25 has a thickness of, e.g., about 2.0 μm. As shown in FIGS. 3 and 4, a portion of the area of the ceramic substrate 11 existing at the left side of the heating resistor support portion 21 is covered with a glass layer 26. The glass layer 26 is the same as the glass layer 25 in terms of material and thickness.

The electrode layer 3 is provided to define a route for applying the current to the resistor layer 4. In the present embodiment, the electrode layer 3 includes a main Au layer 301 and an auxiliary Au layer 304. The main Au layer 301 is made of, e.g., resinate Au having an Au percentage of about 97% and is added with additives such as rhodium, vanadium, bismuth and silicon. In the present embodiment, the main Au layer 301 includes a lower layer 302 and an upper layer 303. The lower layer 302 and the upper layer 303 have a thickness of, e.g., about 0.3 μm. The auxiliary Au layer 304 is formed on the main Au layer 301 and is made of, e.g., resinate Au having an Au percentage of about 99.7%. The auxiliary Au layer 304 has a thickness of about 0.3 μm. Instead of the material set forth above, the auxiliary Au layer 304 may be made of, e.g., a material having an Au percentage of about 60% and mixed with glass frits. In this case, the auxiliary Au layer 304 has a thickness of about 1.1 μm.

The electrode layer 3 includes a plurality of individual electrodes 33, a plurality of relay electrodes 37 and a common electrode 35.

The individual electrodes 33 are provided for partially applying the current to the resistor layer 4. Each of the individual electrodes 33 includes a strip-shaped portion 331, a bent portion 333, a straight portion 334, an oblique portion 335 and a bonding portion 336. The strip-shaped portion 331 has a strip-like shape and extends in the secondary scanning direction y. The strip-shaped portion 331 is positioned on the heating resistor support portion 21. The strip-shaped portion 331 has an opposing edge 332 extending in the primary scanning direction x. The bent portion 333 has a portion joining the strip-shaped portion 331 and another portion being inclined with respect to both the primary scanning direction x and the secondary scanning direction y. In the present embodiment, the bent portion 333 is formed on the heating resistor support portion 21. The straight portion 334 extends straightforward parallel with the secondary scanning direction y. The straight portion 334 is mostly formed on the glass layer 25. One end section of the straight portion 334 overlaps with the heating resistor support portion 21 and the other end section of the straight portion 334 overlaps with the IC electrode support portion 22. The oblique portion 335 extends in a direction inclined with respect to both the primary scanning direction x and the secondary scanning direction y and is formed on the IC electrode support portion 22. The bonding portion 336 is bonded with a wire 81 and is formed on the IC electrode support portion 22. In the present embodiment, the strip-shaped portion 331, the bent portion 333, the straight portion 334 and the oblique portion 335 have a width of, e.g., about 47.5 μm, and the bonding portion 336 has a width of, e.g., about 80 μm.

The common electrode 35 has an electrical polarity that is opposite to the individual electrodes 33 and includes a plurality of strip-shaped portions 351, a plurality of branch portions 353, a plurality of straight portions 354, a plurality of oblique portions 355, a plurality of extension portions 356 and a base portion 357. The strip-shaped portions 351 have a strip-like shape and extend in the secondary scanning direction y. The strip-shaped portions 351 are positioned on the heating resistor support portion 21. The strip-shaped portions 351 have opposing edges 352 extending in the primary scanning direction x. In the present embodiment, two mutually-adjoining strip-shaped portions 351 are interposed between two strip-shaped portions 331. Each of the branch portions 353 interconnects two strip-shaped portions 351 and one straight portion 354 and has a Y-like shape. The branch portions 353 are formed on the heating resistor support portion 21. The straight portions 354 extend straightforward parallel with the secondary scanning direction y. Each of the straight portions 354 is mostly formed on the glass layer 25. One end section of each of the straight portions 354 overlaps with the heating resistor support portion 21 and the other end section of each of the straight portions 354 overlaps with the IC electrode support portion 22. The oblique portions 355 extend in a direction inclined with respect to both the primary scanning direction x and the secondary scanning direction y and are formed on the IC electrode support portion 22. The extension portions 356 have a portion joining the oblique portions 355 and extends in the secondary scanning direction y. The base portion 357 has a strip-like shape and extends in the primary scanning direction x. The extension portions 356 are joined to the base portion 357. In the present embodiment, the strip-shaped portions 351, the straight portions 354, the oblique portions 355 and the extension portions 356 have a width of, e.g., about 47.5 μm.

The relay electrodes 37 are electrically interposed between the individual electrodes 33 and the common electrode 35. Each of the relay electrodes 37 includes two strip-shaped portions 371 and a connecting portion 373. The strip-shaped portions 371 have a strip-like shape and extend in the secondary scanning direction y. The strip-shaped portions 371 are formed on the heating resistor support portion 21. The strip-shaped portions 371 have opposing edges 372 extending in the primary scanning direction x. The connecting portion 373 has a portion interconnecting the two strip-shaped portions 371 of a pair of strip-shaped portions and extends in the primary scanning direction x.

The strip-shaped portions 331 and 351 are arranged along the primary scanning direction x. On the heating resistor support portion 21, the strip-shaped portions 371 are arranged at the opposite side of the strip-shaped portions 331 and 351 along the secondary scanning direction y. The opposing edges 352 of the adjoining strip-shaped portions 351 are located opposite in the secondary scanning direction y to the opposing edges 372 of the adjoining strip-shaped portions 371 of the adjoining relay electrodes 37 with a gap left therebetween. The opposing edges 372 of the remaining two strip-shaped portions 371 of the adjoining relay electrodes 37 are located opposite in the secondary scanning direction y to the opposing edges 332 of two strip-shaped portions 331 with a gap left therebetween. Each of the strip-shaped portions 331 and each of the strip-shaped portions 371 located opposite each other in the secondary scanning direction y make up a pair of strip-shaped portions referred to herein. Likewise, each of the strip-shaped portions 351 and each of the strip-shaped portions 371 located opposite each other in the secondary scanning direction y make up a pair of strip-shaped portions referred to herein. The strip-shaped portions 331, 351 and 371 arranged along the primary scanning direction x make up plural pairs of strip-shaped portions referred to herein.

Figure 5:
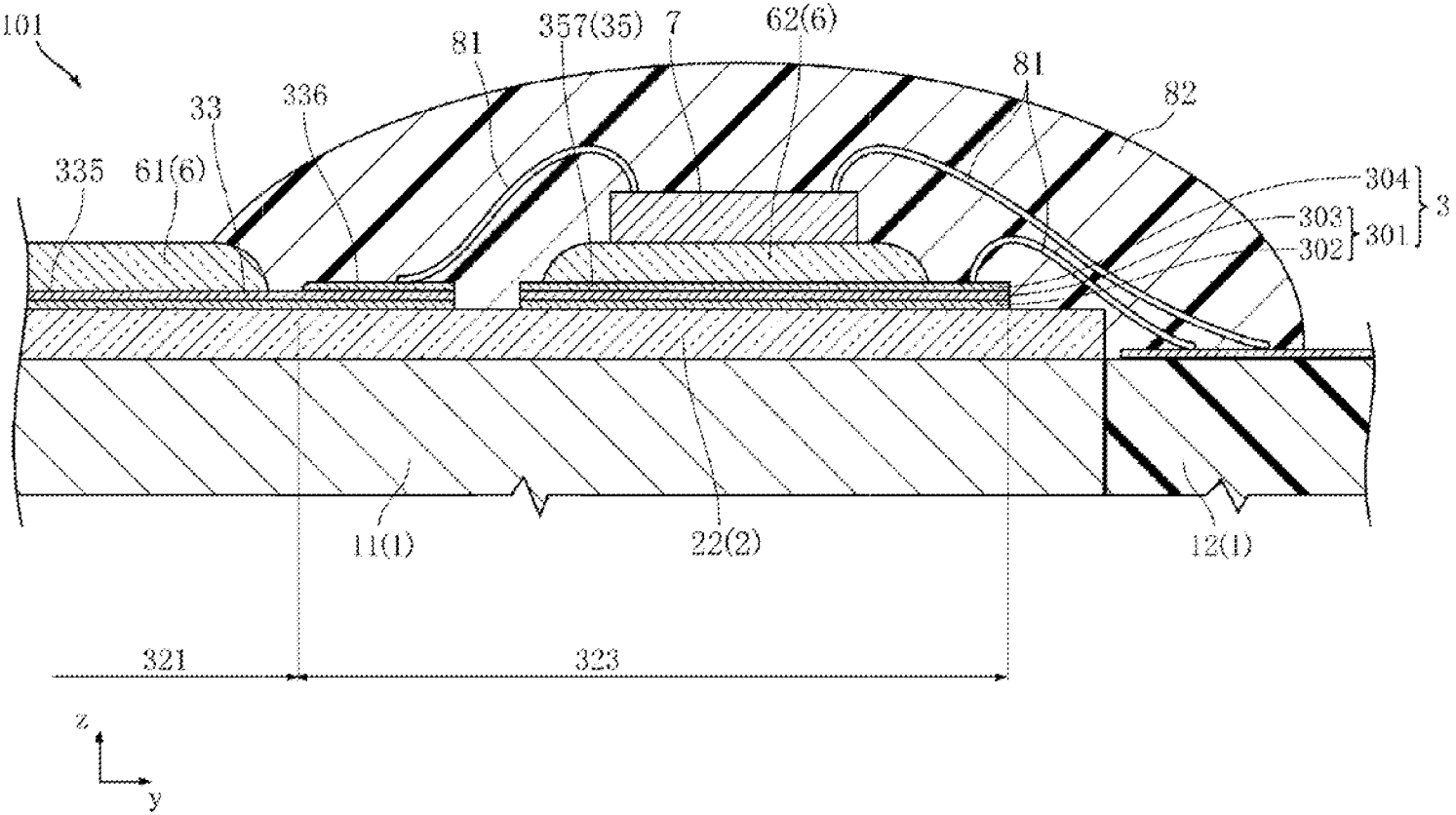
FIG. 5 is a section view of major portions taken along line III-III in FIG. 2.

As shown in FIGS. 4 and 5, the electrode layer 3 is divided into a normal thickness portion 321, a reduced thickness portion 322 and an increased thickness portion 323. The normal thickness portion 321 is formed of the main Au layer 301 and is arranged to occupy most of the electrode layer 3. The reduced thickness portion 322 is formed of the lower layer 302 and corresponds to the portion of the opposing edges 332, 352 and 372 of the strip-shaped portions, 331, 351 and 371. The increased thickness portion 323 has the portion where the main Au layer 301 and the auxiliary Au layer 304 overlap with each other and corresponds to the bonding portion 336, the extension portions 356 and the base portion 357. In the present embodiment, the normal thickness portion 321 has a thickness of about 0.6 μm, the reduced thickness portion 322 having a thickness of 0.3 μm and the increased thickness portion 323 having a thickness of about 0.9 μm. If the auxiliary Au layer 304 is made of a material mixed with glass frits as stated above, the increased thickness portion 323 has a thickness of about 1.7 μm.

As shown in FIG. 3, the tip end sections of the strip-shaped portions 331 and 371 (and the strip-shaped portions 351) are sunk with respect to the heating resistor support portion 21. This sinkage is such that the upper surfaces of the tip end sections of the strip-shaped portions 331, 351 and 371 are flush with or a little higher than the heating resistor support portion 21.

The resistor layer 4 is heated when current is partially applied by the electrode layer 3. Print dots are formed by the heating of the resistor layer 4. The resistor layer 4 is made of, e.g., $TaSiO_2$ or TaN, and is about 300 to 2,000 Å in thickness. The resistor layer 4 is divided into a plurality of heating portions 41 and a plurality of electrode covering portions 42. Each of the heating portions 41 is arranged on the heating resistor support portion 21 to cover the gap between each of the opposing edges 331 and 351 and each of the opposing edge 371. The heating portions 41 are heated when current is applied. The electrode covering portions 42 are formed to lie between the electrode layer 3 and the protective layer 5. In the present embodiment, the electrode covering portions 42 cover all the relay electrodes 37, all the strip-shaped portions 331 and 351, all the bent portions 333, all the branch portions 353 and all the straight portions 334 and 354. The electrode covering portions 42 are formed to jut out from the strip-shaped portions 331, 351 and 371 about 4 μm in the width direction.

The protective layer 5 is provided to protect the electrode layer 3 and the resistor layer 4. In the present embodiment, the protective layer 5 includes a lower layer 51 and an upper layer 52 formed one above another. The lower layer 51 is made of, e.g., $SiO_2$, and is about 2 μm in thickness. The upper layer 52 is made of, e.g., a material containing SiC, and is about 6 μm in thickness. The protective layer 5 is formed over a region ranging from one end of the ceramic substrate 11 in the secondary scanning direction y to the sections of the straight portions 334 and 354 lying on the IC electrode support portion 22. The electrode covering portions 42 of the resistor layer 4 are interposed between the protective layer 5 and the electrode layer 3. Thus, the protective layer 5 and the electrode layer 3 are kept out of contact with each other.

The resin layer 6 is made of an insulating resin and includes an electrode portion 61 and an IC portion 62. The electrode portion 61 covers the oblique portions 335 and 355 and the extension portions 356. The IC portion 62 is formed on the base portion 357 of the common electrode 35 to support the drive IC 7. The resin layer 6 is made of, e.g., a transparent epoxy resin.

The drive IC 7 is provided to selectively apply current to the heating portions 41 of the resistor layer 4 through the individual electrodes 33. The drive IC 7 is mounted to the IC portion 62 of the resin layer 6. A plurality of pads 71 is formed on an upper surface of the drive IC 7 in two rows. The pads 71 belonging to the row close to the individual electrodes 33 in the secondary scanning direction y are connected to the bonding portions 336 by the wires 81. The pads 71 belonging to the row distant from the individual electrodes 33 in the secondary scanning direction y are connected through the wires 81 to wiring patterns formed in the wiring substrate 12. The wiring patterns serve to electrically interconnect the connector 83 and the drive IC 7. The base portion 357 of the common electrode 35 and the wiring patterns of the wiring substrate 12 are connected by the wires 81.

The encapsulation resin 82 is made of, e.g., a black resin, to protect the drive IC 7 and the wires 81. In the present embodiment, one end of the encapsulation resin 82 in the secondary scanning direction y overlaps with the electrode portion 61 of the resin layer 6. The other end of the encapsulation resin 82 in the secondary scanning direction y reaches the wiring substrate 12.

Next, a method of manufacturing the thermal print head 101 will be described with reference to FIGS. 6 through 26.

Figure 6:
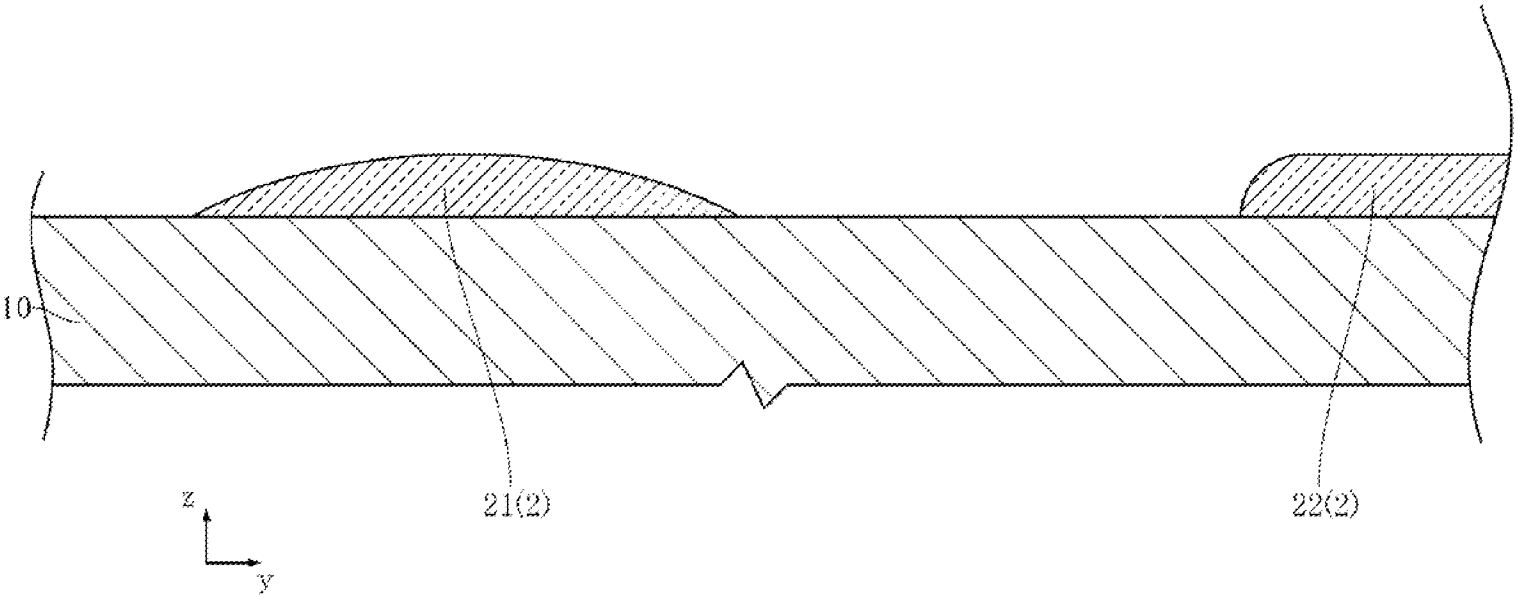
FIG. 6 is a section view of major portions showing a state in which a glaze layer is formed on a substrate according to one example of a method of manufacturing the thermal print head shown in FIG. 1.
Figure 7:
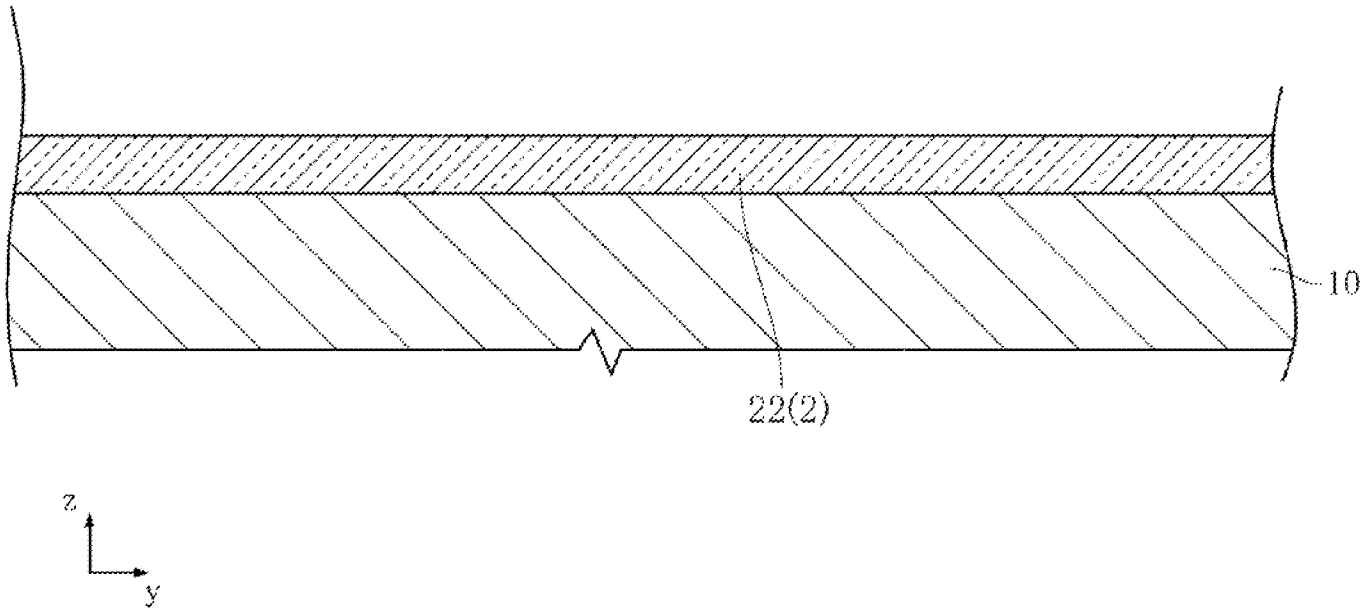
FIG. 7 is a section view of major portions showing a state in which a glaze layer is formed on the substrate according to one example of the method of manufacturing the thermal print head shown in FIG. 1.

Referring first to FIGS. 6 and 7, a ceramic substrate material 10 is prepared. The ceramic substrate material 10 is a plate-like material from which a plurality of ceramic substrates can be diced. The ceramic substrate material 10 is made of ceramic, e.g., $Al_2O_3$, and has a thickness of, e.g., about 0.6 to 1.0 mm. A glaze layer 2 is formed on the ceramic substrate material 10. The formation of the glaze layer 2 is performed by thick-film printing, e.g., glass-containing paste on the areas corresponding to the heating resistor support portion 21 and the IC electrode support portion 22 and then sintering the paste thus printed. In the present embodiment, a heating resistor support portion 21 is shaped such that the dimension thereof in the secondary scanning direction y becomes equal to, e.g., about 700 μm, and the dimension thereof in the thickness direction z becomes equal to, e.g., about 18 to 50 μm.

Figure 8:
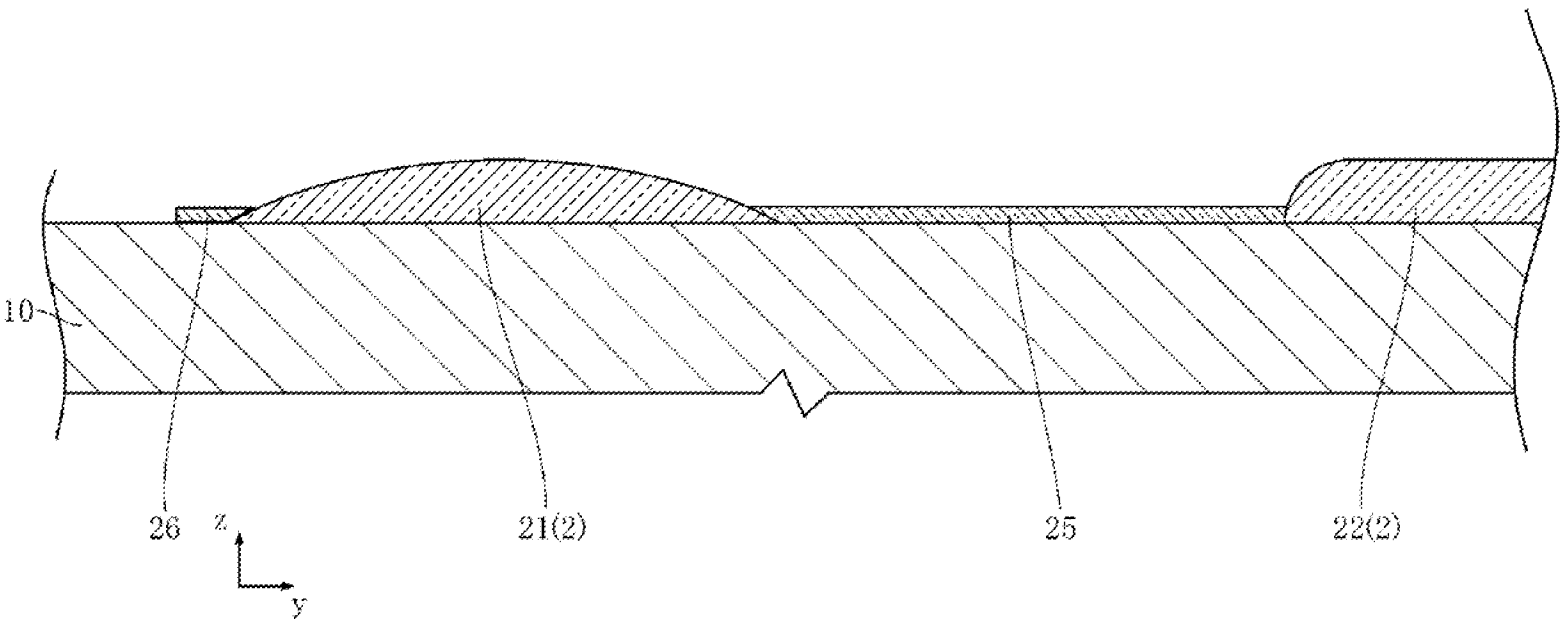
FIG. 8 is a section view of major portions showing a state in which a glass layer is formed according to one example of the method of manufacturing the thermal print head shown in FIG. 1.

Next, glass layers 25 and 26 are formed as shown in FIG. 8. The formation of the glass layers 25 and 26 is performed by thick-film printing, e.g., glass-containing paste on the area between the heating resistor support portion 21 and the IC electrode support portion 22 and on the area at the left side of the heating resistor support portion 21 in FIG. 8 and then sintering the paste thus printed. At this time, the sintering temperature is, e.g., 790 to 800 degrees C. The printing and sintering is carried out such that the thickness of the glass layer 25 becomes equal to about 2.0 μm.

Figure 9:
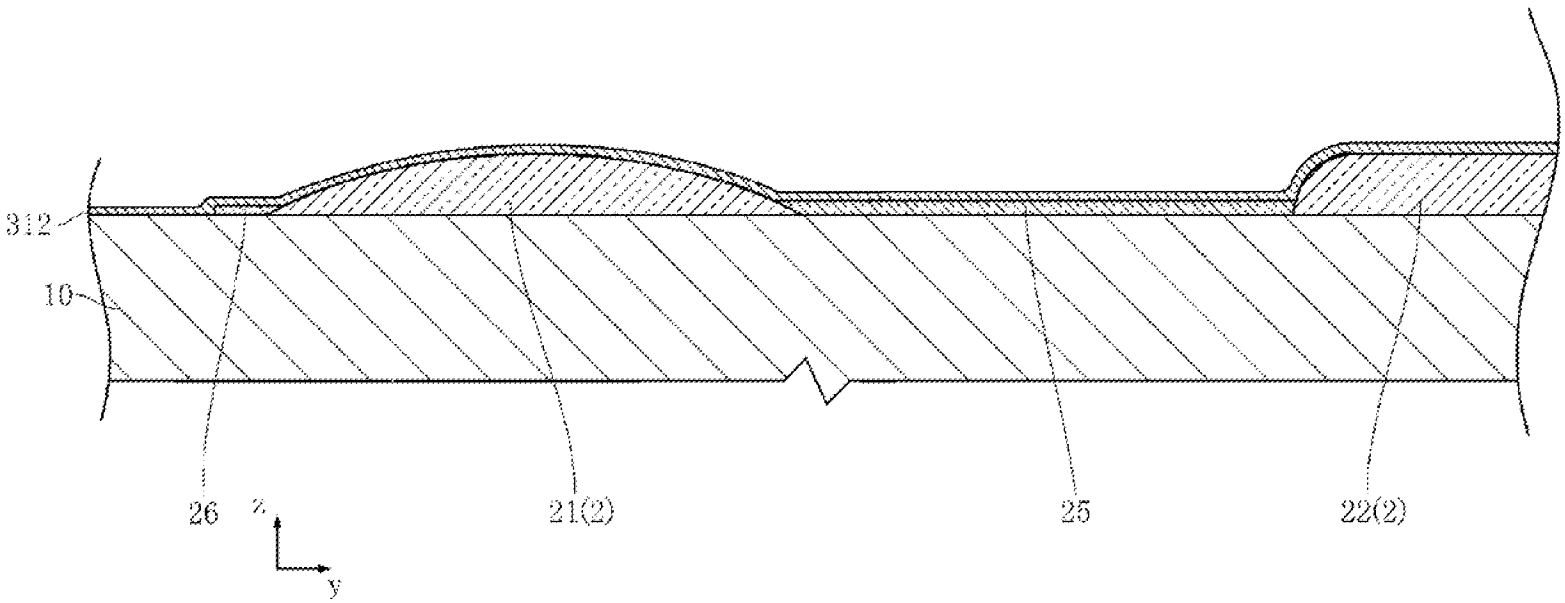
FIG. 9 is a section view of major portions showing a state in which a lower layer of a main Au layer is formed according to one example of the method of manufacturing the thermal print head shown in FIG. 1.
Figure 10:
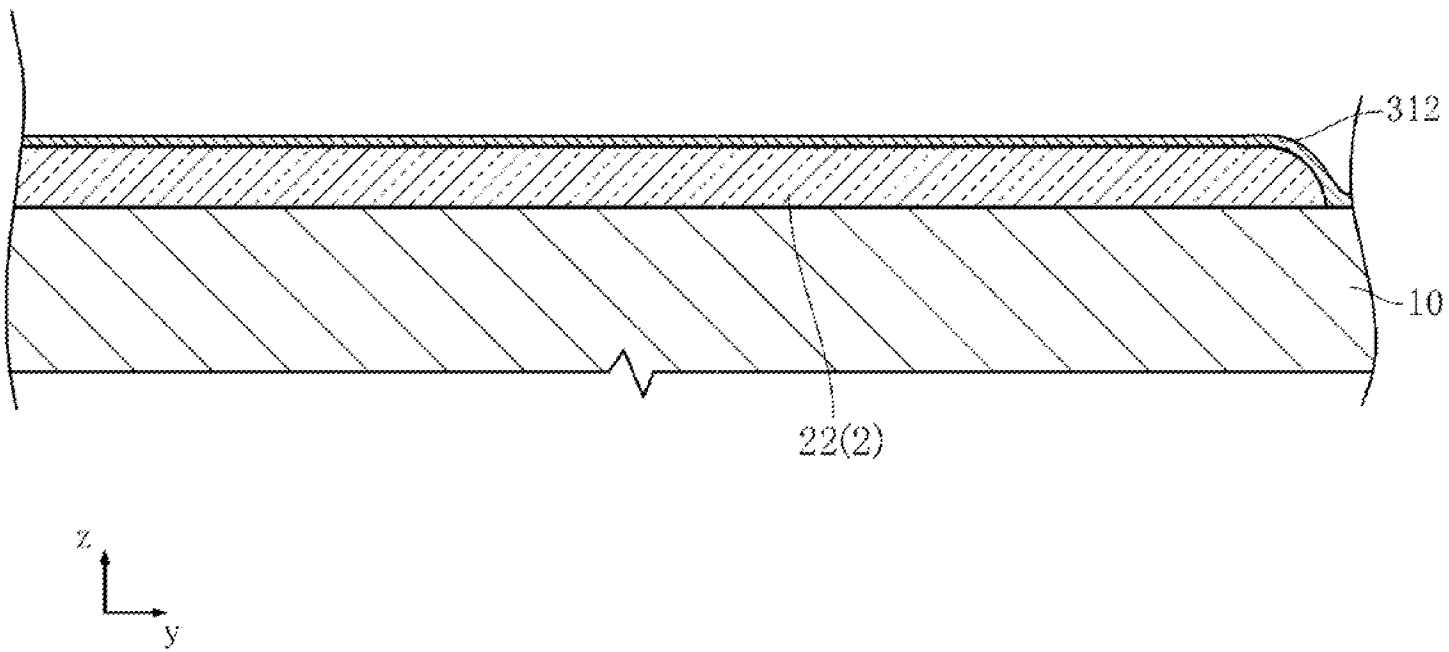
FIG. 10 is a section view of major portions showing a state in which the lower layer of the main Au layer is formed according to one example of the method of manufacturing the thermal print head shown in FIG. 1.

Next, a lower layer 312 is formed as shown in FIGS. 9 and 10. The formation of the lower layer 312 is performed by thick-film printing, e.g., resinate Au paste, on the entire surface of the ceramic substrate material 10 and then sintering the resinate Au paste thus printed. At this time, the sintering temperature is, e.g., about 790 degrees C. The lower layer 312 has a thickness of, e.g., about 0.3 μm, and an Au percentage of about 97%.

Figure 11:
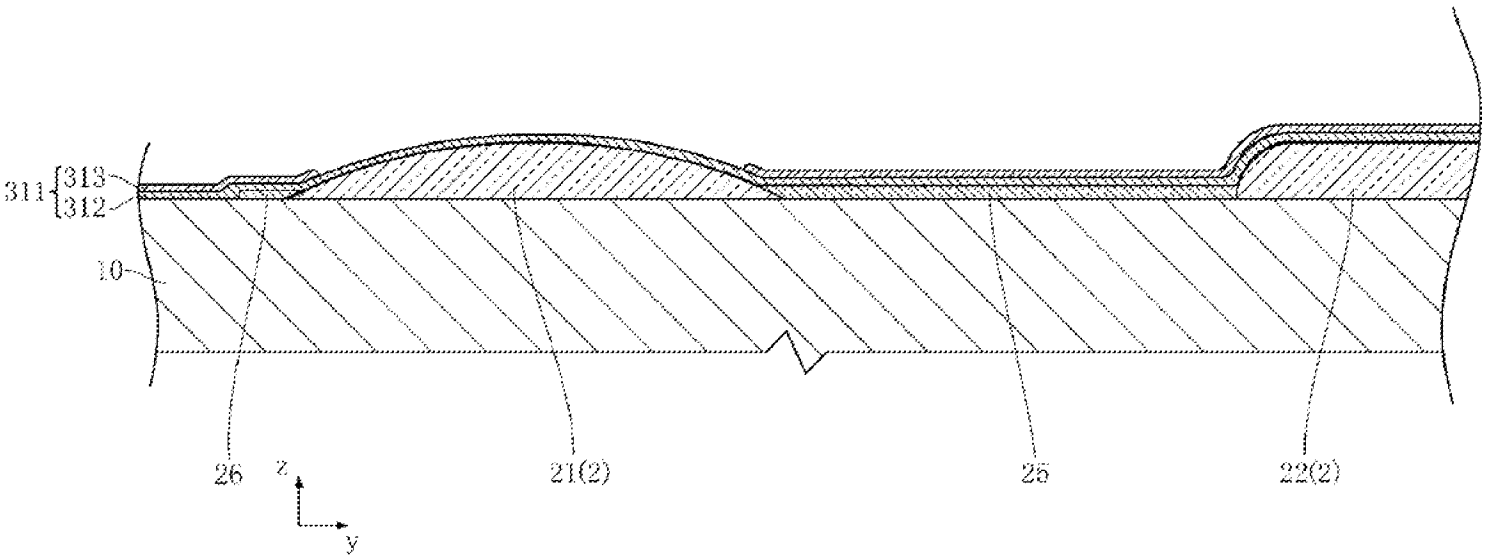
FIG. 11 is a section view of major portions showing a state in which an upper layer of the main Au layer is formed according to one example of the method of manufacturing the thermal print head shown in FIG. 1.
Figure 12:
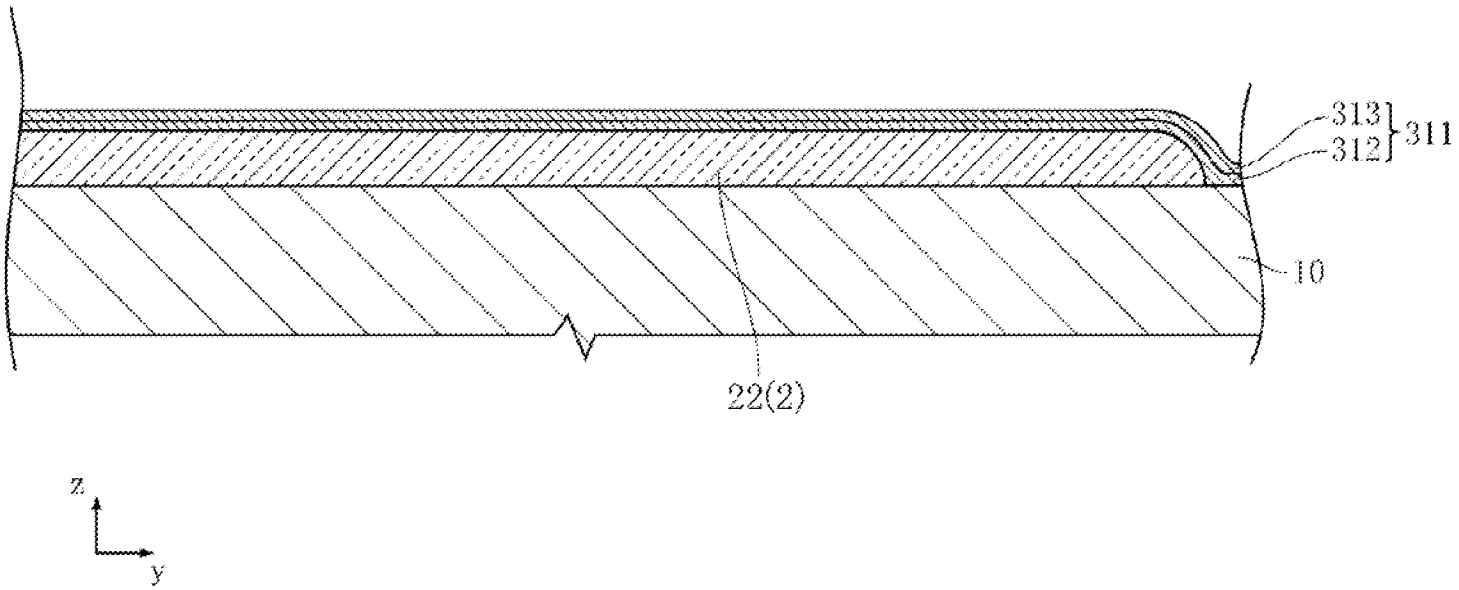
FIG. 12 is a section view of major portions showing a state in which the upper layer of the main Au layer is formed according to one example of the method of manufacturing the thermal print head shown in FIG. 1.

Next, an upper layer 313 is formed as shown in FIGS. 11 and 12. The formation of the upper layer 313 is performed by thick-film printing, e.g., resinate Au paste, on the lower layer 312 and then sintering the resinate Au paste thus printed. In the thick-film printing, as shown in FIG. 11, the area of the lower layer 312 covering the heating resistor support portion 21 is exposed for the most part thereof. At this time, the sintering temperature is, e.g., about 790 degrees C. The upper layer 313 has a thickness of, e.g., about 0.3 μm, and an Au percentage of about 97%. A main Au layer 311 is obtained by forming the lower layer 312 and the upper layer 313.

Figure 13:
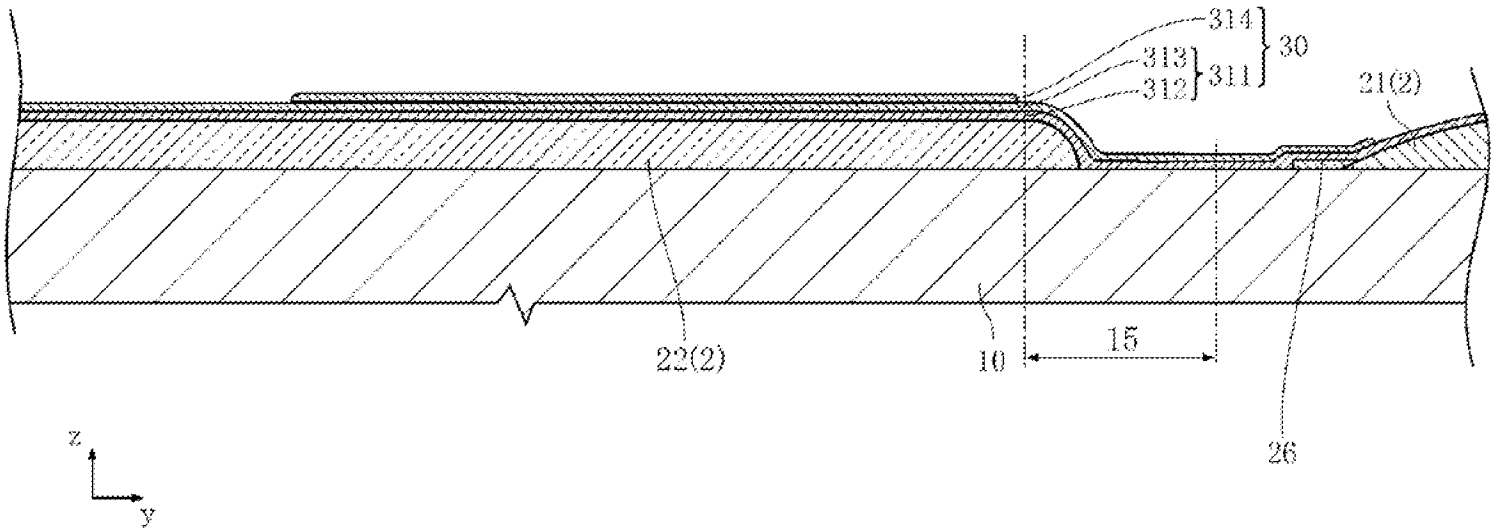
FIG. 13 is a section view of major portions showing a state in which an auxiliary Au layer is formed according to one example of the method of manufacturing the thermal print head shown in FIG. 1.
Figure 14:
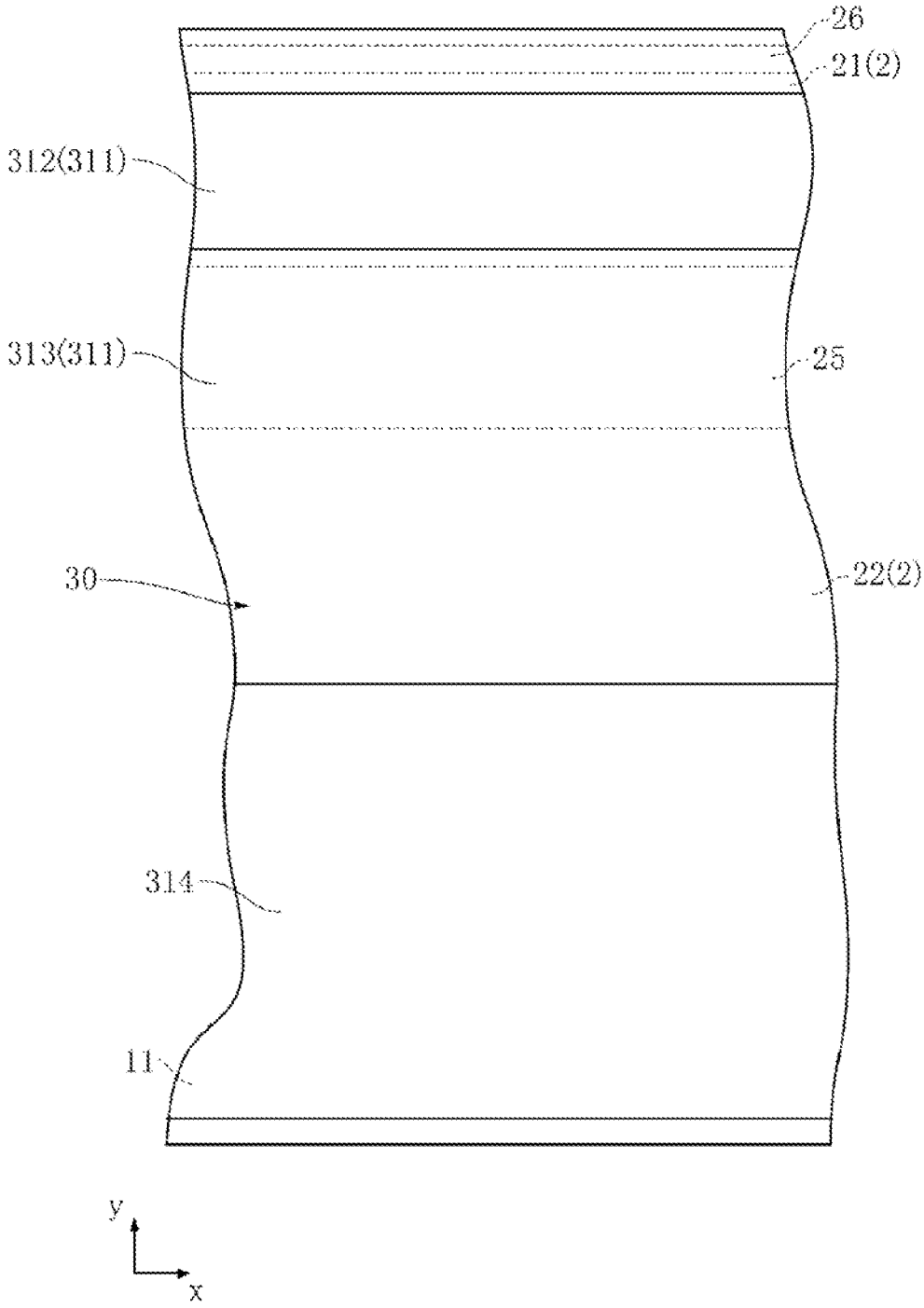
FIG. 14 is a plan view of major portions showing a state in which the auxiliary Au layer is formed according to one example of the method of manufacturing the thermal print head shown in FIG. 1.

Next, an auxiliary Au layer 314 is formed as shown in FIG. 13. The formation of the auxiliary Au layer 314 is performed by thick-film printing, e.g., resinate Au paste, so as to cover a portion of the main Au layer 311 and then sintering the resinate Au paste thus printed. The auxiliary Au layer 314 has a thickness of, e.g., about 0.3 μm, and an Au percentage of about 99.7%. An Au layer 30 shown in FIG. 14 is obtained by forming the main Au layer 311 and the auxiliary Au layer 314. Alternatively, the formation of the auxiliary Au layer 314 may be performed by thick-film printing paste containing granular glass and Au and then sintering the paste thus printed. In this case, the auxiliary Au layer 314 obtained has a thickness of, e.g., about 1.1 μm, and an Au percentage of about 60%. A cutting region 15 shown in FIG. 13 is removed when the ceramic substrate material 10 is cut into a plurality of ceramic substrates 11 in a later process.

Figure 15:
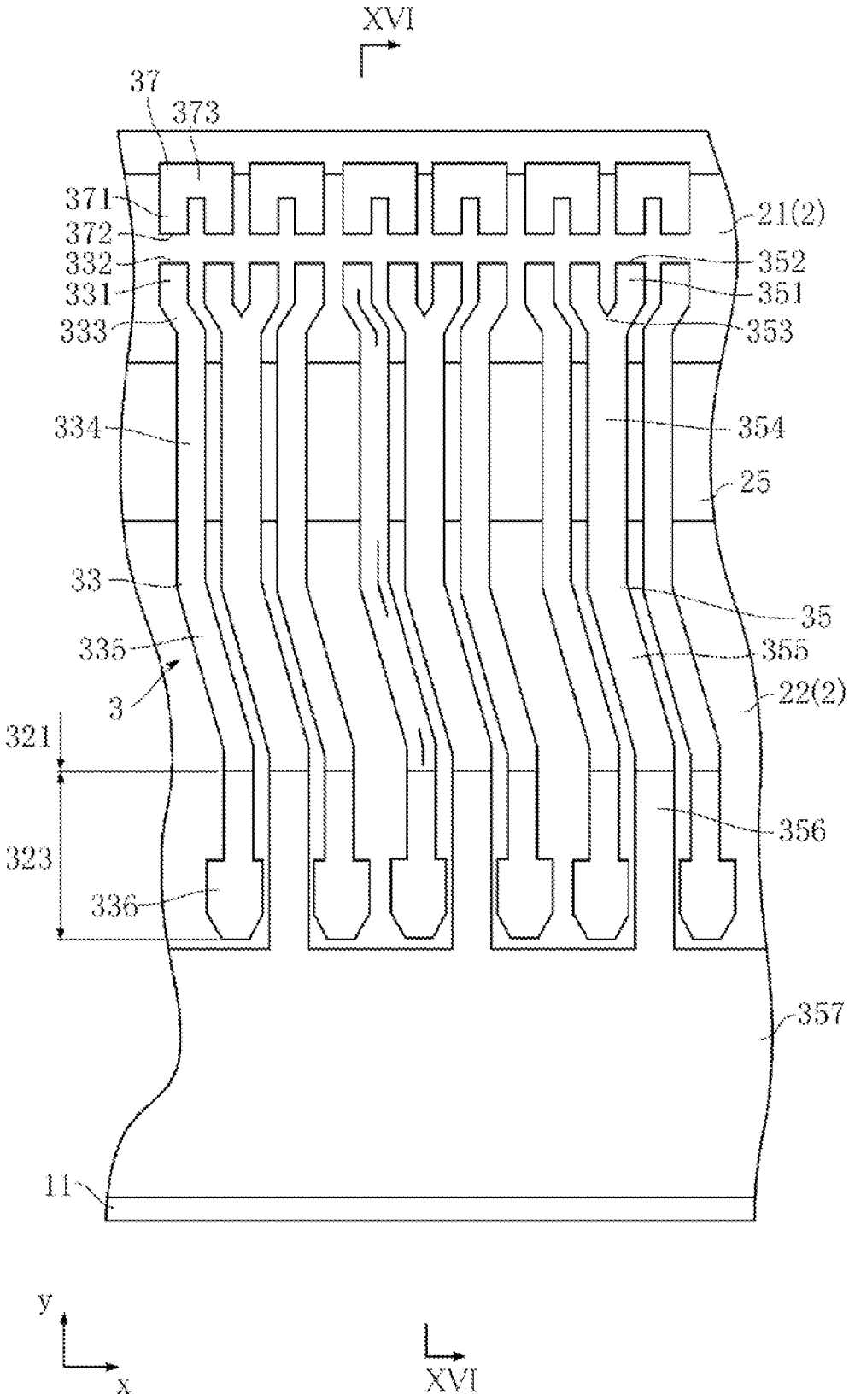
FIG. 15 is a plan view of major portions showing a state in which the main Au layer and the auxiliary Au layer are etched according to one example of the method of manufacturing the thermal print head shown in FIG. 1.
Figure 16:
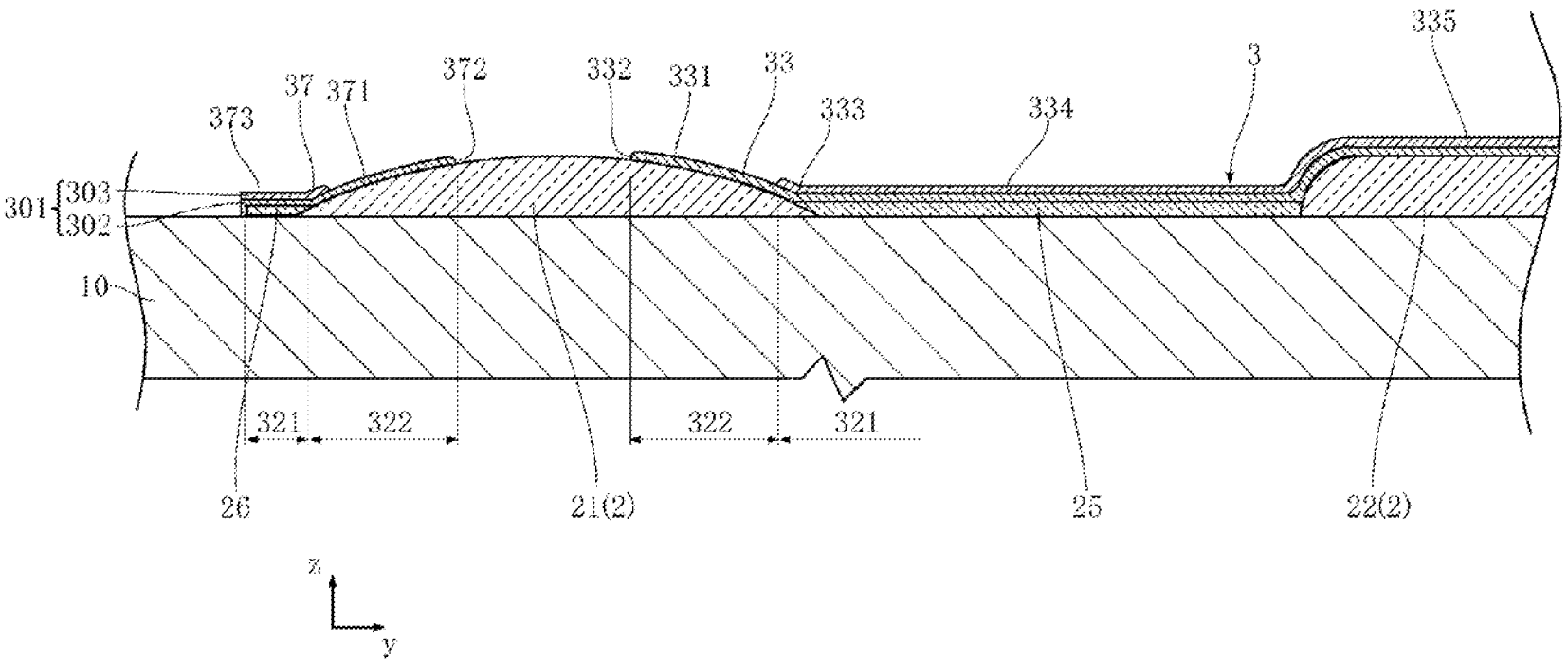
FIG. 16 is a section view taken along line XVI-XVI in FIG. 15.
Figure 17:
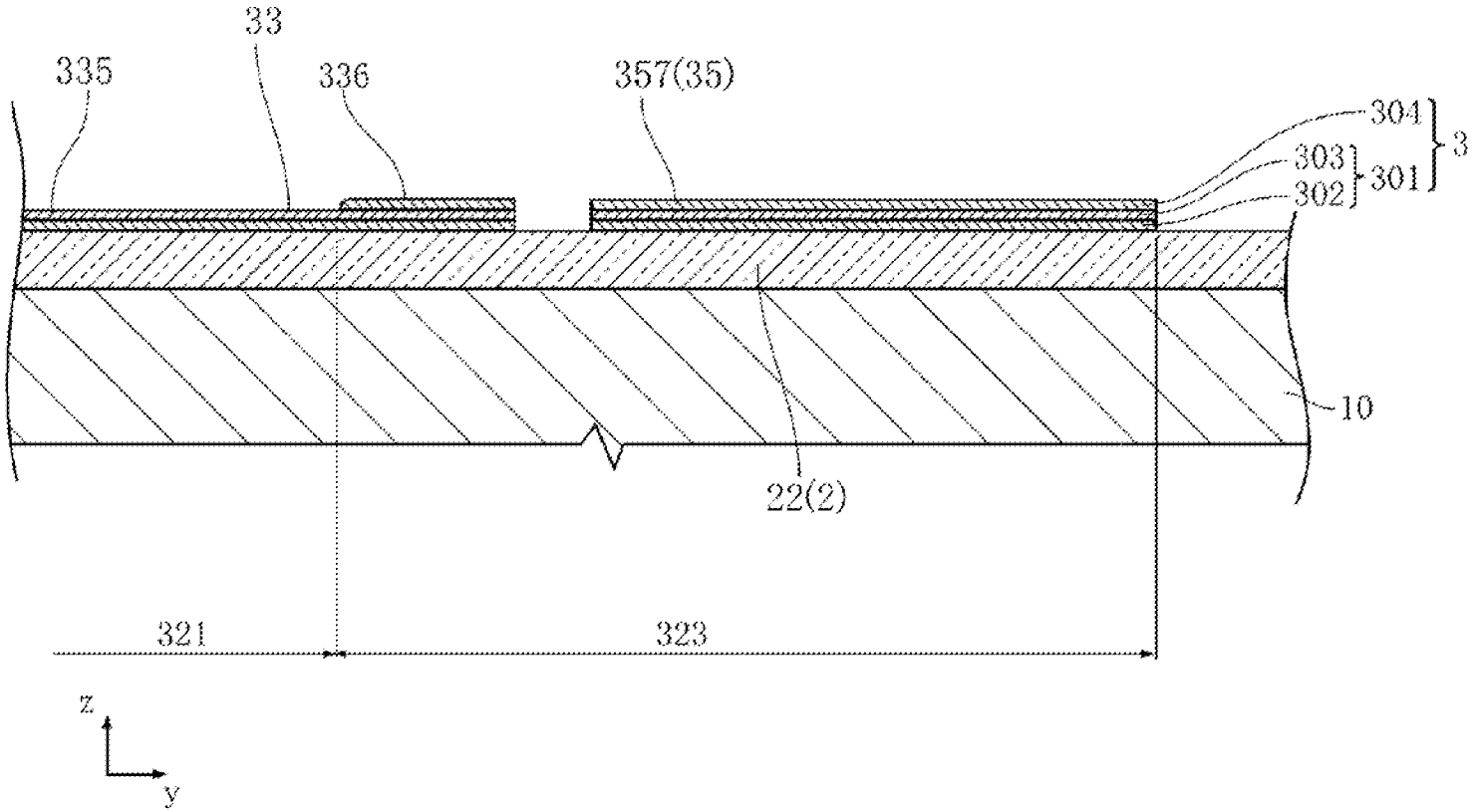
FIG. 17 is a section view taken along line XVI-XVI in FIG. 15.

Next, the Au layer 30 is subjected to patterning. This patterning is performed by forming a mask on the Au layer 30 through an exposure process using a photolithography method and conducting, an etching process using the mask. By virtue of the patterning, it is possible to obtain an electrode layer 3 including a main Au layer 301, which is composed of a lower layer 302 and an upper layer 303, and an auxiliary Au layer 304 as shown in FIGS. 15 through 17. The electrode layer 3 includes the normal thickness portion 321, the reduced thickness portion 322 and the increased thickness portion 323, which are set forth above. The electrode layer 3 is divided into the individual electrodes 33, the relay electrodes 37 and the common electrode 35, which are described above.

Figure 18:
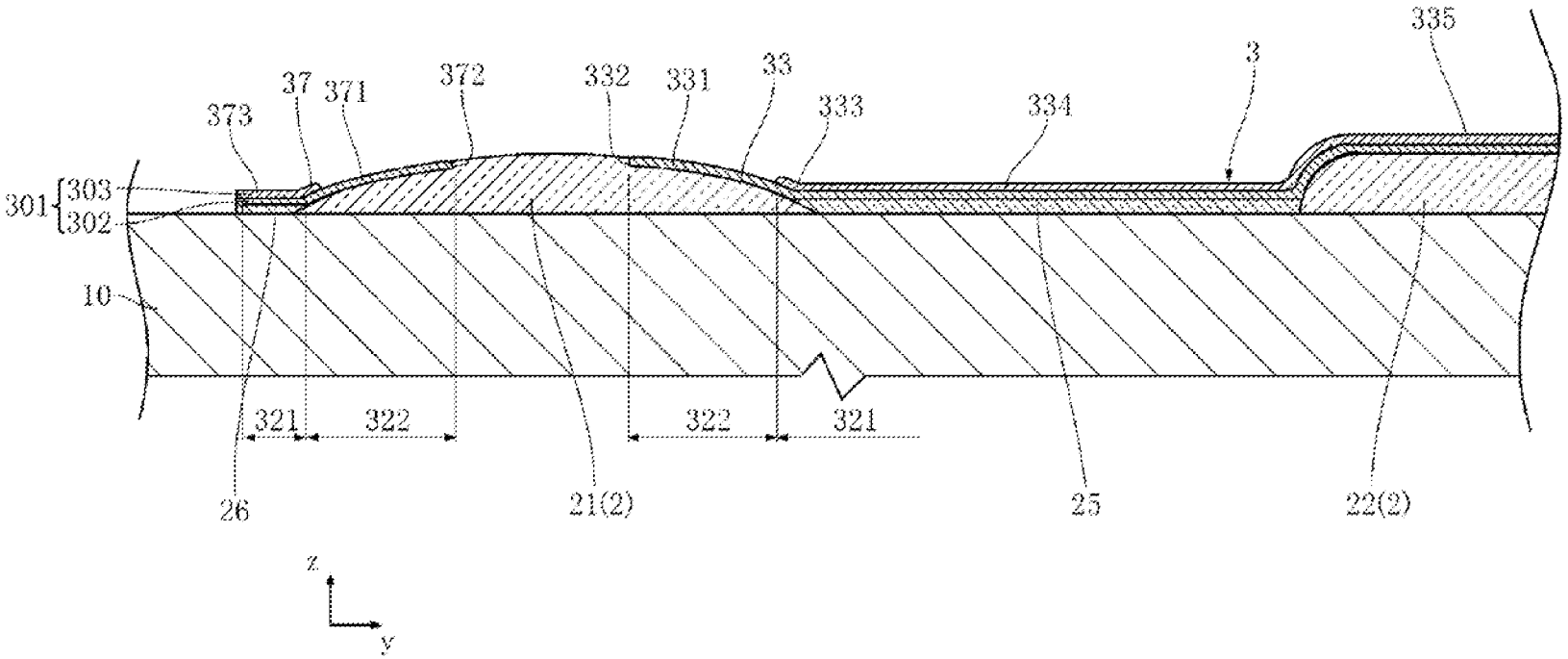
FIG. 18 is a section view of major portions showing a state in which a strip-shape portion is sunk according to one example of the method of manufacturing the thermal print head shown in FIG. 1.

Next, the ceramic substrate material 10 having the aforementioned respective components formed thereon is subjected to a heat treatment. The heat treatment is performed by repeating, e.g., twice, a process of heating the ceramic substrate material 10 as a whole to, e.g., 830 degrees C. The heating resistor support portion 21 of the glaze layer 2 is softened by the heat treatment. Thus, the strip-shaped portions 331, 351 and 371 are a little sunk with respect to the heating resistor support portion 21 as shown in FIG. 18. In the present embodiment, the heating resistor support portion 21 has a relatively small thickness of about 18 to 50 μm. For that reason, the tip end sections of the strip-shaped portions 331, 351 and 371 are sunk such that the upper surfaces thereof become substantially flush with the upper surface of the heating resistor support portion 21. However, the base end sections of the strip-shaped portions 331, 351 and 371 are scarcely sunk with respect to the heating resistor support portion 21.

Figure 19:
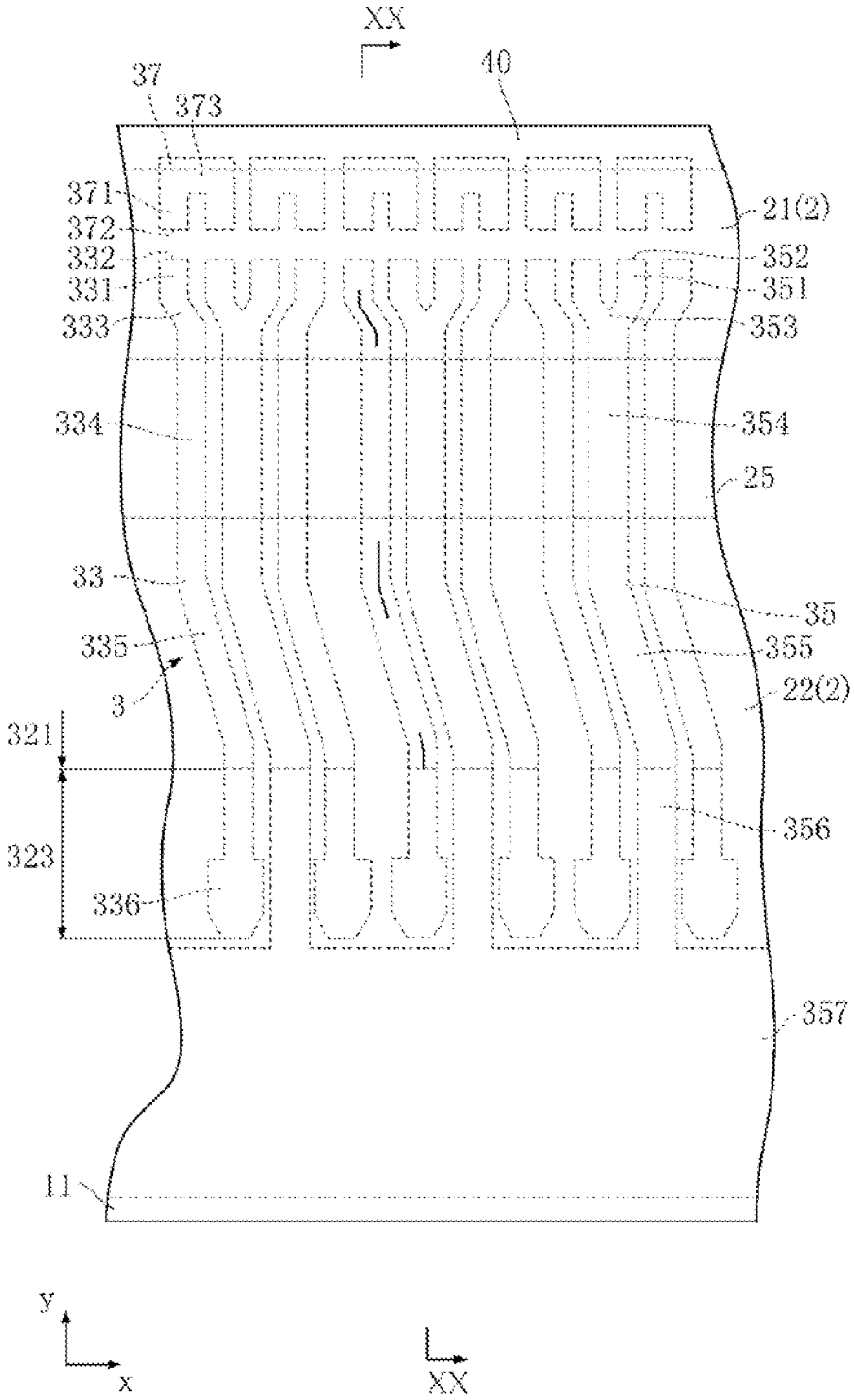
FIG. 19 is a plan view of major portions showing a state in which a resistor layer is formed according to one example of the method of manufacturing the thermal print head shown in FIG. 1.
Figure 20:
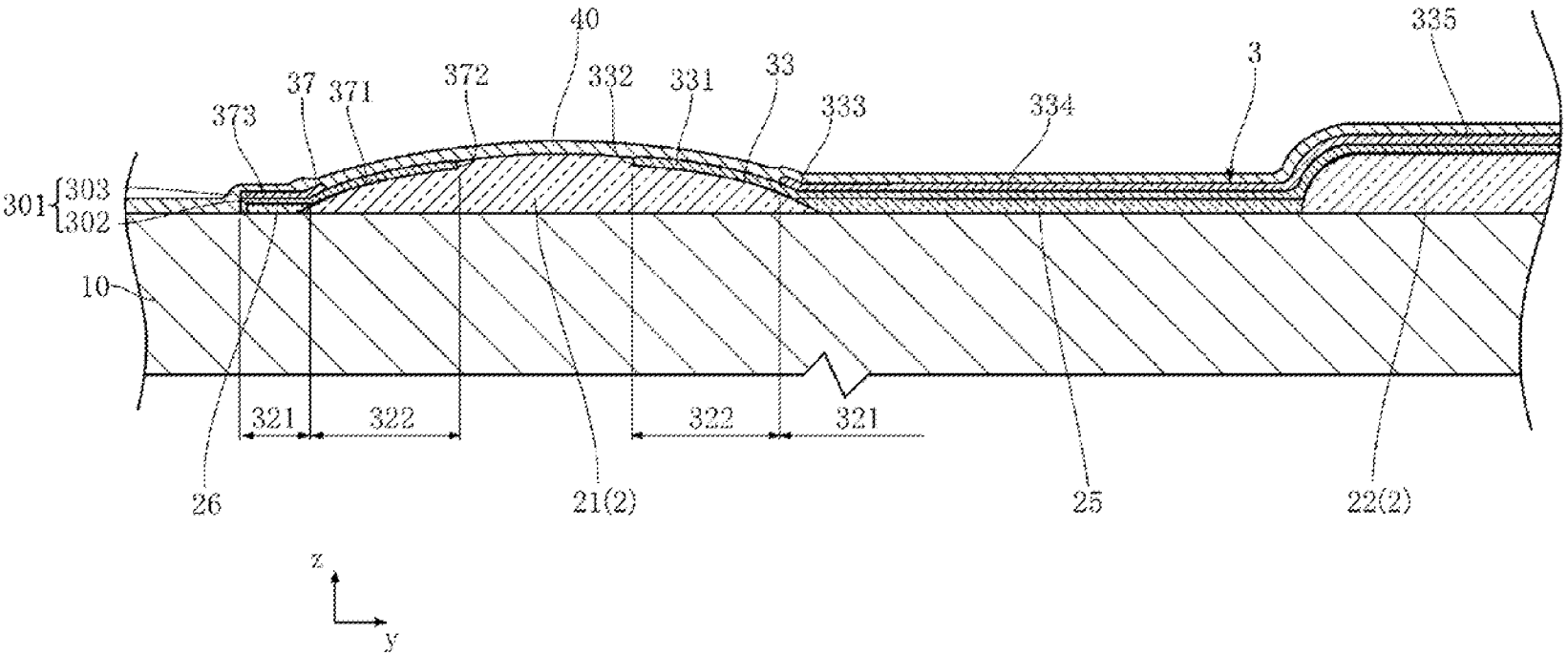
FIG. 20 is a section view taken along line XX-XX in FIG. 19.

Next, a resistor layer 40 is formed as shown in FIGS. 19 and 20. The formation of the resistor layer 40 is performed by sputtering a material, e.g., $TaSiO_2$ or TaN, so as to cover, e.g., the entire surface of the ceramic substrate material 10. The resistor layer 40 has a thickness of, e.g., about 300 to 2,000 Å.

Figure 21:
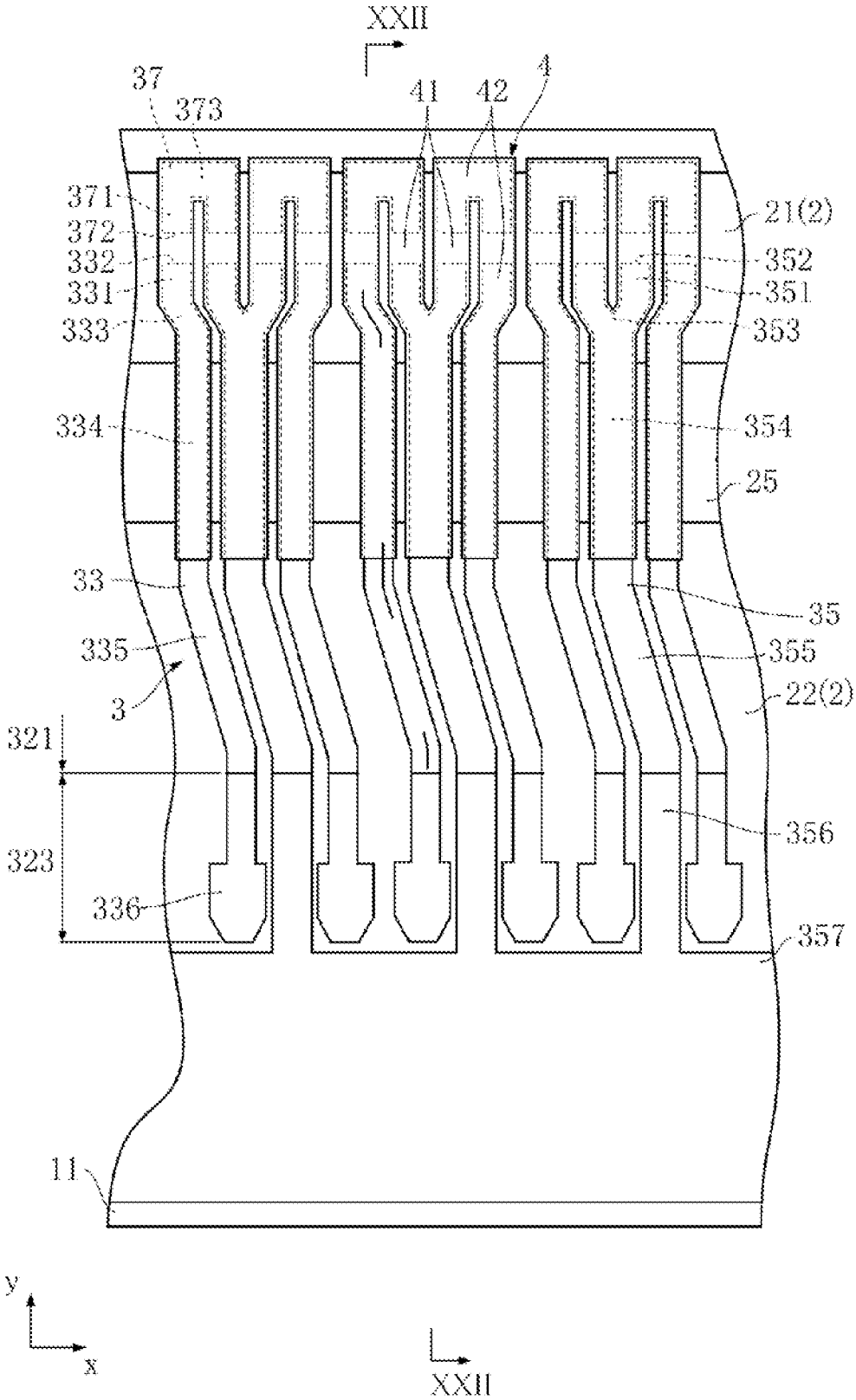
FIG. 21 is a plan view of major portions showing a state in which the resistor layer is etched according to one example of the method of manufacturing the thermal print head shown in FIG. 1.
Figure 22:
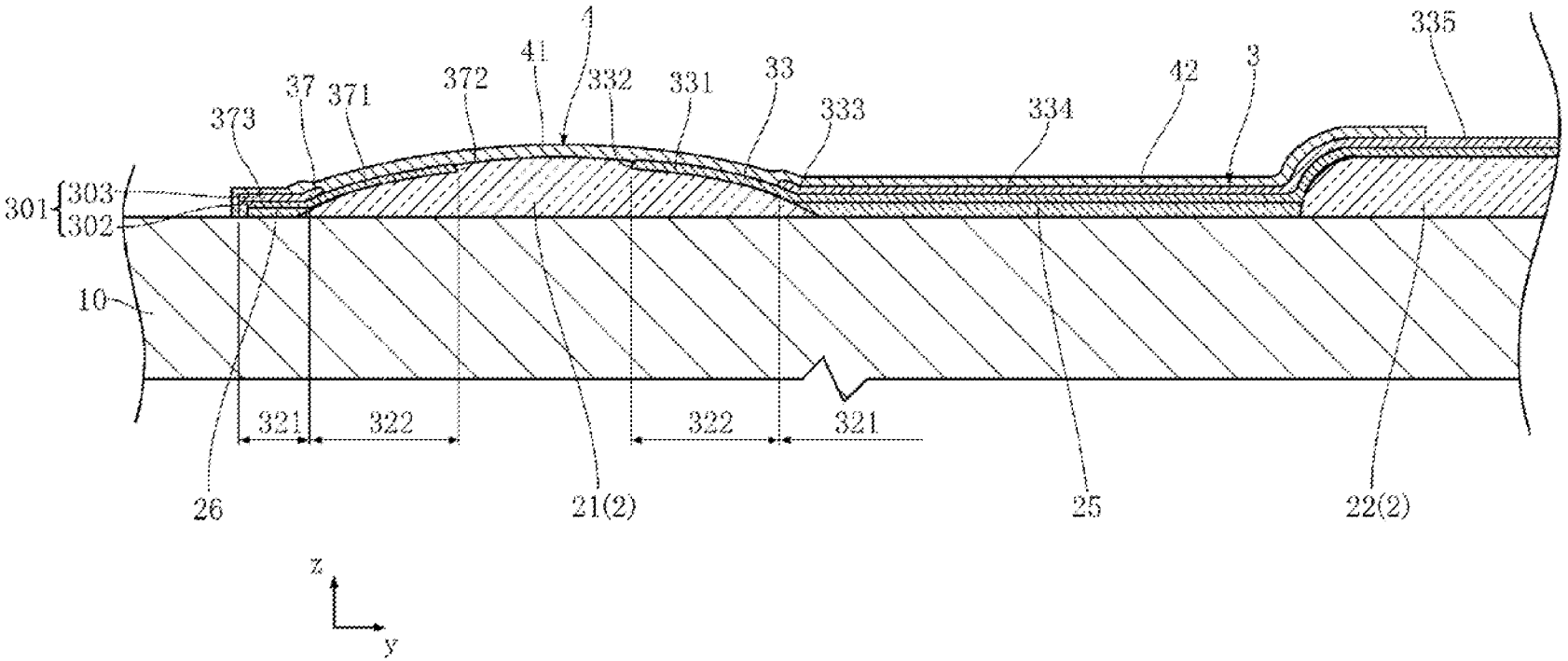
FIG. 22 is a section view taken along line XXII-XXII in FIG. 21.

Next, the resistor layer 40 is subjected to patterning. This patterning, is performed by forming a mask on the resistor layer 40 through an exposure process using a photolithography method and conducting an etching process using the mask. By virtue of the patterning, it is possible to obtain a resistor layer 4 including a plurality of heating portions 41 and a plurality of electrode covering portions 42 as shown in FIGS. 21 through 22.

Figure 23:
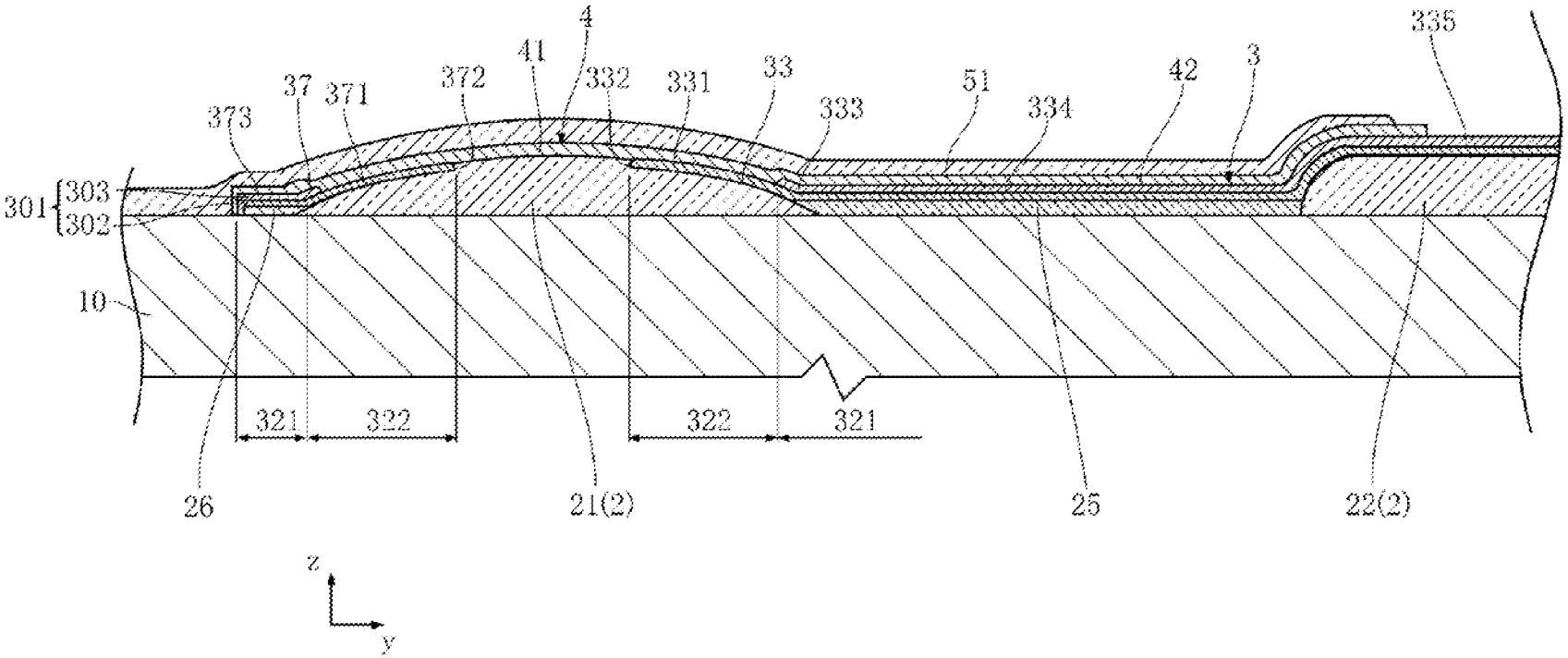
FIG. 23 is a section view of major portions showing a state in which a lower layer of a protective layer is formed according to one example of the method of manufacturing the thermal print head shown in FIG. 1.

Next, a lower layer 51 is formed as shown in FIG. 23. The formation of the lower layer 51 is performed by forming a mask to expose desired regions and then conducting a sputtering process or a CVD process using, e.g., $SiO_2$. The lower layer 52 has a thickness of, e.g., about 2.0 μm. The electrode covering portions 42 of the resistor layer 4 is interposed between the lower layer 51 and the electrode layer 3.

Figure 24:
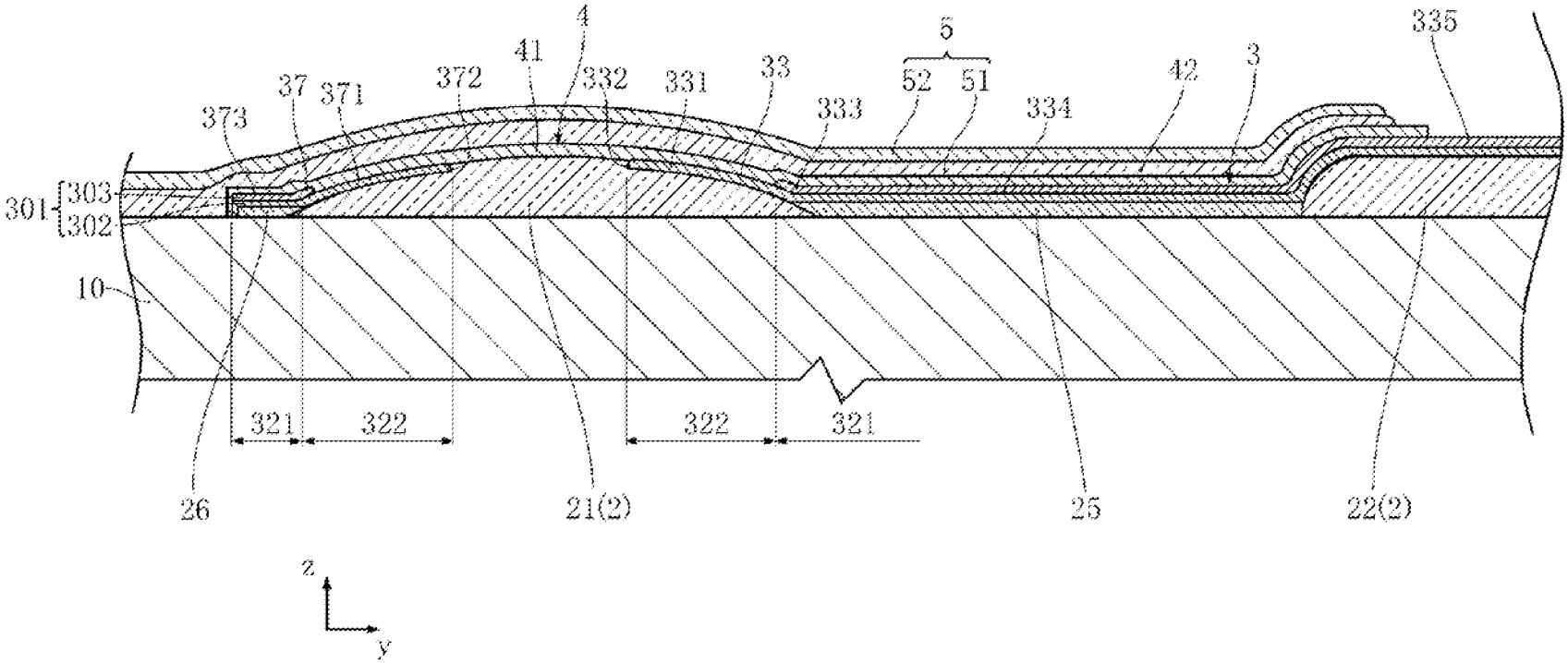
FIG. 24 is a section view of major portions showing a state in which an upper layer of the protective layer is formed according to one example of the method of manufacturing the thermal print head shown in FIG. 1.

Next, an upper layer 52 is formed as shown in FIG. 24. The formation of the upper layer 52 is performed by conducting a sputtering process or a CVD process using, e.g., SiC, so that the upper layer 52 can overlap with the lower layer 51. The upper layer 52 has a thickness of, e.g., about 6.0 μm. By forming the tower layer 51 and the upper layer 52, it is possible to obtain a protective layer 5 having a thickness of, e.g., 8.0 μm.

Figure 25:
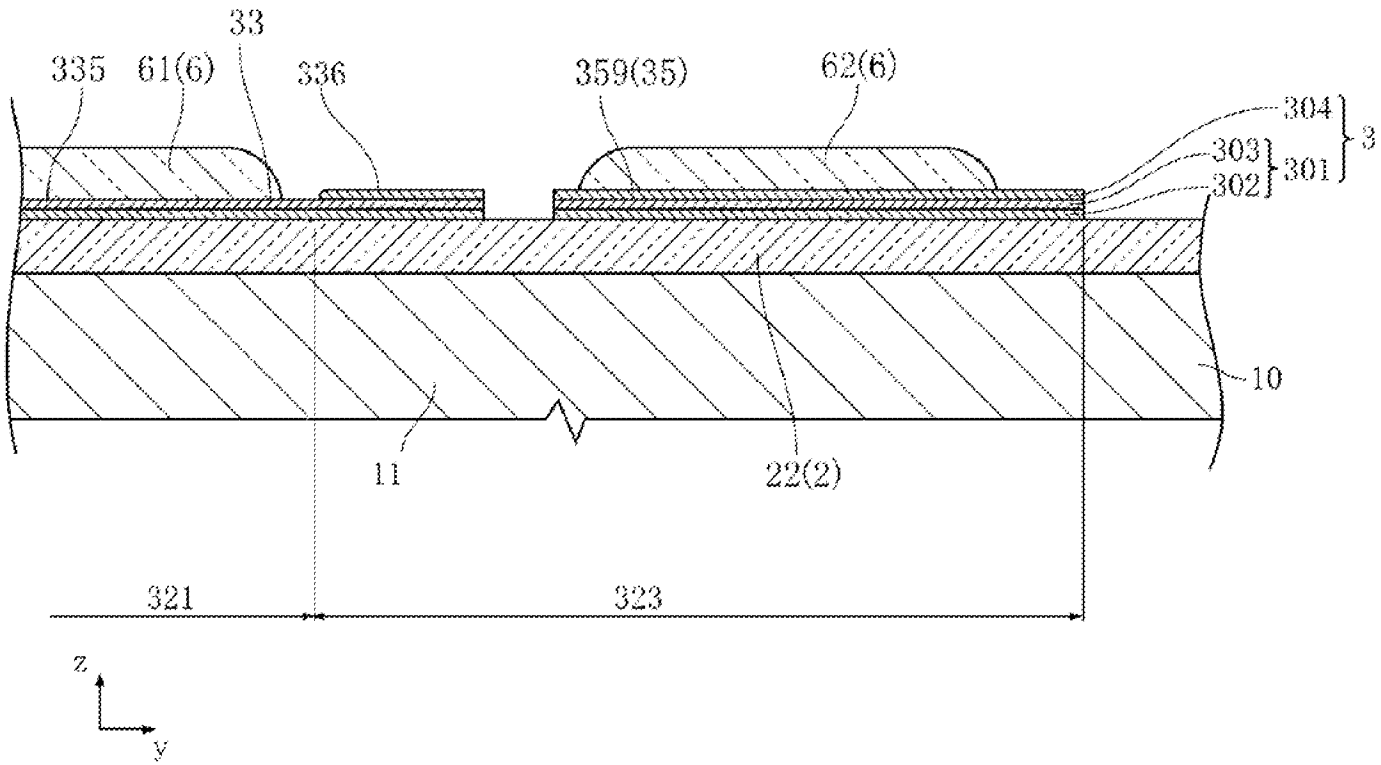
FIG. 25 is a section view of major portions showing a state in which a resin layer is formed according to one example of the method of manufacturing the thermal print head shown in FIG. 1.

Next, a resin layer 6 is formed as shown in FIG. 25. The formation of the resin layer 6 is performed by applying, e.g., a transparent resin material, on the regions corresponding to the electrode portion 61 and the IC portion 62.

Figure 26:
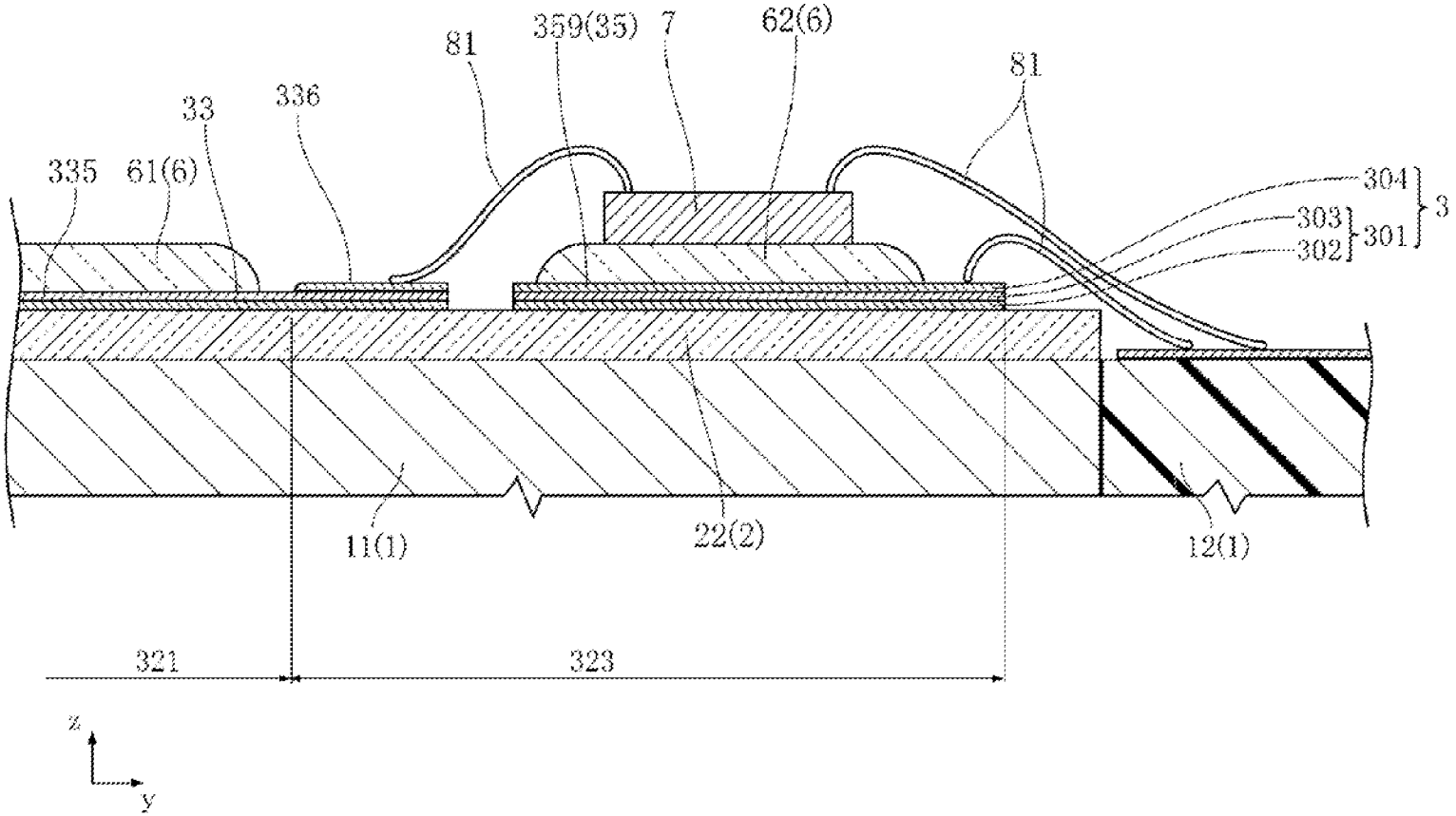
FIG. 26 is a section view of major portions showing a state in which a drive IC is mounted according to one example of the method of manufacturing the thermal print head shown in FIG. 1.

Next, a drive IC 7 is mounted to the IC portion 62 as shown in FIG. 26. Thereafter, the ceramic substrate material 10 is divided into a plurality of ceramic substrates 11 by cutting the same in the manner as illustrated in FIG. 13. The ceramic substrate 11 and the wiring substrate 12 having the connector 83 are attached to a heat radiating plate 13. Then, a plurality of wires 81 are bonded. Thereafter, an encapsulation resin 82 is formed. A thermal print head 101 is finally obtained through the processes described above.

Next, description will be made on the actions of the thermal print head 101 and the manufacturing method thereof.

With the present embodiment, the tip end sections of the strip-shaped portions 331, 351 and 371 are formed of the reduced thickness portions 322. This makes it possible to restrain the tip end edges 332, 352 and 372 of the strip-shaped portions 331, 351 and 371 from having a marked step difference. Accordingly, there is no need to configure the resistor layer 4 to cover the marked step difference, which assists in avoiding damage of the resistor layer 4.

The base end sections of the strip-shaped portions 331, 351 and 371 and the area of the electrode layer 3 joined thereto are formed of the normal thickness portions 321. This makes it possible to prevent the electric resistance value of the electrode layer 3 from becoming unduly high.

By sinking the tip end sections of the strip-shaped portions 331, 351 and 371 with respect to the heating resistor support portion 21 of the glaze layer 2, it is possible to restrain a step difference from being generated in the border between the heating resistor support portion 21 and the strip-shaped portions 331, 351 and 371. Making the tip end sections of the strip-shaped portions 331, 351 and 371 flush with the heating resistor support portion 21 helps remove the step difference.

By configuring the normal thickness portion 321 from the main Au layer 301 formed of the lower layer 302 and the upper layer 303 and by configuring the reduced thickness portion 322 from only the lower layer 302, it becomes easy to locate the border of the normal thickness portion 321 and the reduced thickness portion 322 in a desired position. Since the position of the border can be defined by thick-film printing, it is possible to secure adequate accuracy.

With the present embodiment, the bonding portion 336 is formed of the increased thickness portion 323. The increased thickness portion 323 has an increased thickness of about 0.9 μm (or about 1.7 μm) while the normal thickness portion 321 has a thickness of about 0.6 μm. Thanks to this feature, the bonding portion 336 is less likely to suffer from damage even if pressure is applied thereto when bonding the wire 81. This also helps reduce stress concentration occurring in the bonded area of the wire 81 and the bonding portion 336 when a tensile force acts on the bonding portion 336 through the wire 81. Accordingly, it is possible to restrain the wire 81 and the bonding portion 336 from being peeled off.

The increased thickness portion 323 is formed of the main Au layer 301 and the auxiliary Au layer 304. The auxiliary Au layer 304 is greater in Au percentage than the main Au layer 301 and therefore helps increase the bonding force with the wire 81 made of Au. If the auxiliary Au layer 304 is made of a material mixed with Au and glass, the surface of the auxiliary Au layer 304 tends to have a relatively high number of uneven shapes. This makes it possible to increase the contact area between the bonding portion 336 and the wire 81. This also makes it possible to increase the bonding force of the wire 81 and the bonding portion 336.

The main Au layer 301 is added with additives such as rhodium, vanadium, bismuth and silicon. These additives are particularly effective in increasing the bonding force of the glass-made glaze layer 2 with the IC electrode support portion 22. This makes it possible to prevent the bonding portion 336 from being peeled off.

In the present embodiment, the base portion 357 of the common electrode 35 is formed of the increased thickness portion 323. The drive IC 7 is mounted to the increased thickness portion 323 through the IC portion 62 of the resin layer 6. This configuration helps avoid the occurrence of severe stress concentration in the area of the base portion 357 to which the drive IC 7 is mounted. The wires 81 leading to the wiring substrate 12 are bonded to the base portion 357. Configuring the base portion 357 from the increased thickness portion 323 helps increase both the bonding force of the base portion 357 with the wires 81 and the bonding force of the base portion 357 with the IC electrode support portion 22 of the glaze layer 2, which has an advantage in restraining the wires 81 and the base portion 357 from being peeled off.

With the present embodiment, no portion of the protective layer 5 makes direct contact with the electrode layer 3. The electrode layer 3 is mainly composed of Au and the protective layer 5 formed of glass through a sputtering process are bonded with a relatively weak bonding force. In contrast, the resistor layer 4 made of, e.g., $TaSiO_2$ or TaN, is bonded to the protective layer 5 with a relative strong bonding force. Accordingly, it is possible to restrain the protective layer 5 from being peeled off.

With the present embodiment, the portions of the electrode layer 3 existing between the heating resistor support portion 21 and the IC electrode support portion 22 is formed on the glass layer 25. These portions are formed into a strip shape with a small size and, therefore, are likely to suffer from disconnection or other problems if the base thereof is coarse. Inasmuch as the glass layer 25 is made of, e.g., glass having a softening point lower than the softening point of the glass of which the glaze layer 2 is made, it is easy to smoothen the surface of the glass layer 25. This makes it possible to avoid disconnection of the electrode layer 3. Only the straight portions 334 and 354 of the electrode layer 3 are positioned on the glass layer 25. Since the straight portions 334 and 354 have a rectilinear shape, there is no possibility that a concentrated stress often generated in, e.g., a bent portion, acts on the straight portions 334 and 354. Accordingly, it is possible to prevent the straight portions 334 and 354 from being severely displaced or bent.

The straight portions 334 and 354 extend in the secondary scanning direction y in a mutually parallel relationship. If the straight portions 334 and the straight portions 354 are equal in number, it is therefore possible to maximize the pitch thereof. This helps prevent the problem of the straight portions 334 and 354 making contact with each other.

In the present embodiment, the straight portions 334 and 354 are covered with the electrode covering portions 42 of the resistor layer 4. The sections of the electrode covering portions 42 are formed into a strip shape with a small size. Since the straight portions 334 and 354 are hardly displaced or bent, it is possible to prevent the sections of the electrode covering portions 42 from making contact with each other.

FIGS. 27 through 36 show another embodiment of the present disclosure. In these figures, the same or similar components as those of the foregoing embodiment are designated by the same reference symbols as used in the foregoing embodiment.

Figure 27:
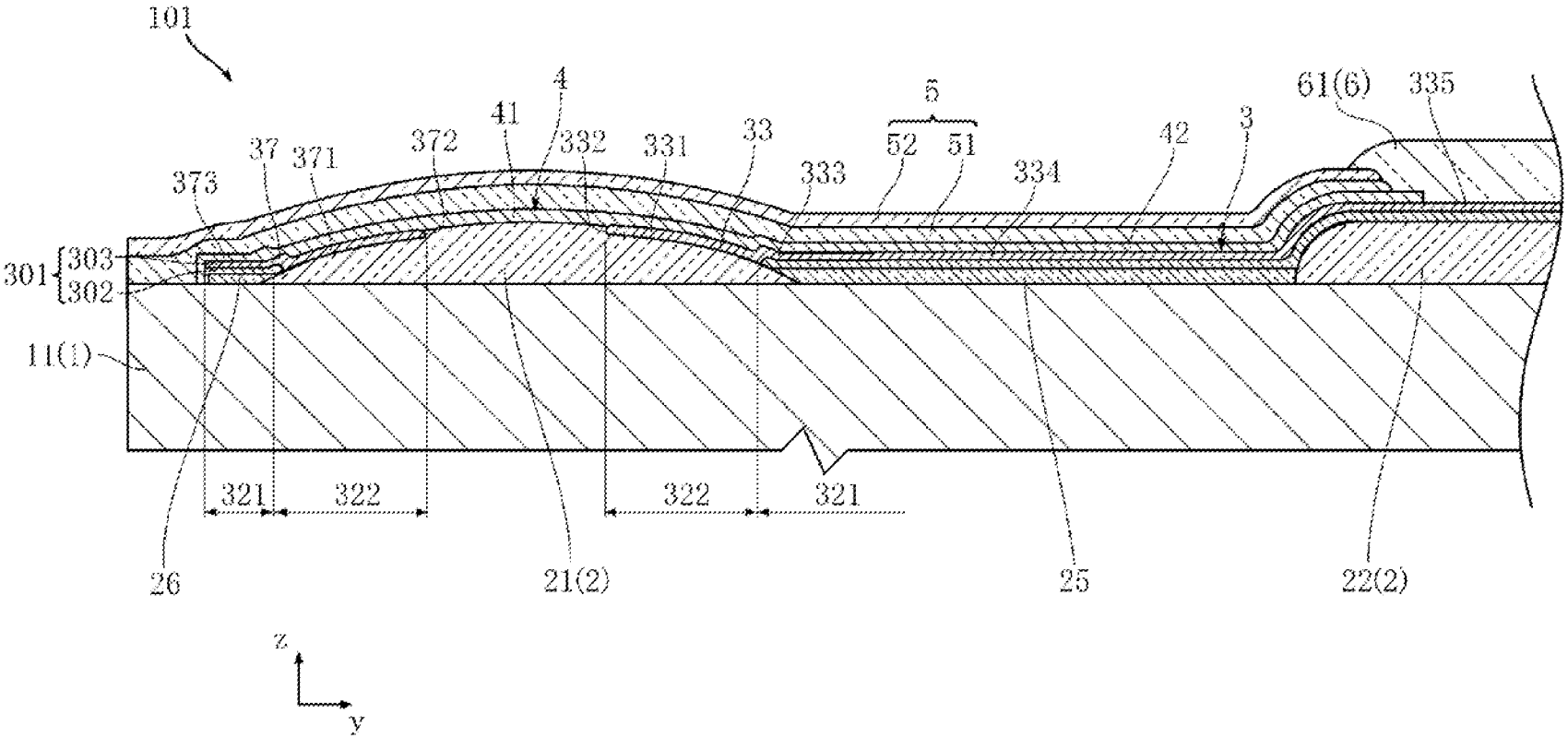
FIG. 27 is a section view of major portions showing a modified example of the thermal print head according to the first embodiment of the present disclosure.
Figure 28:
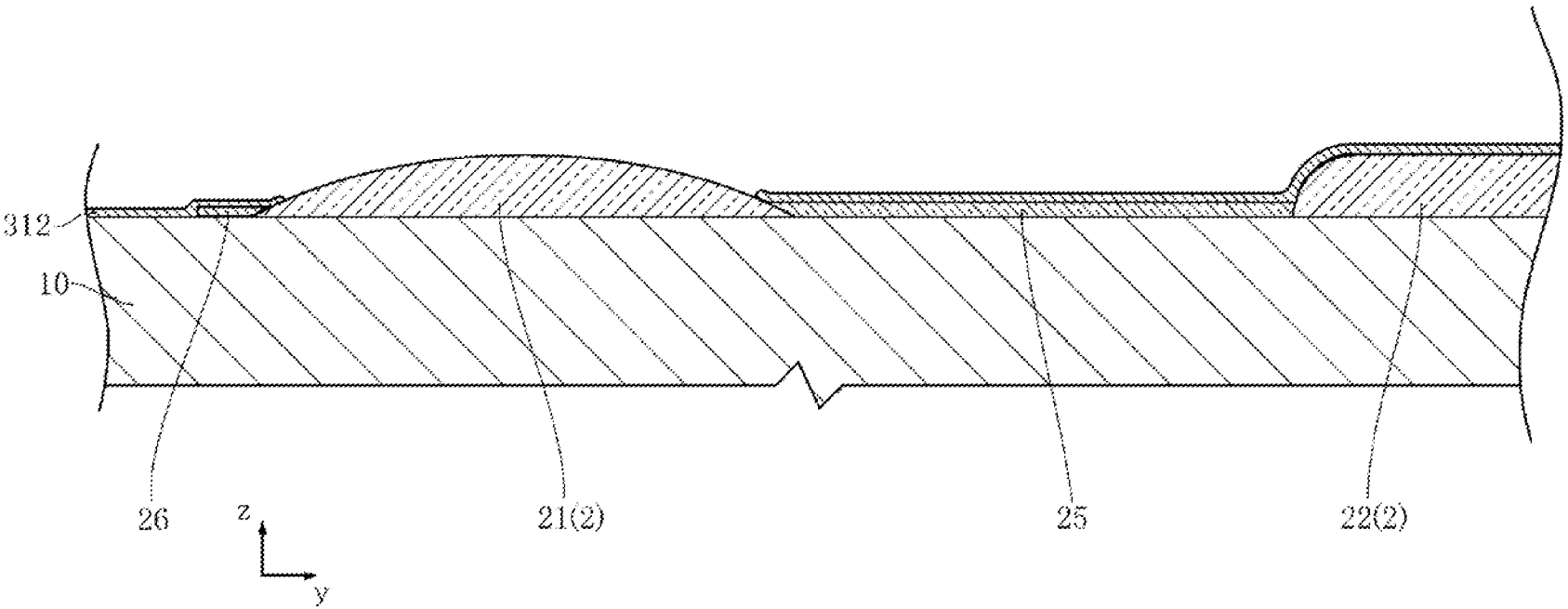
FIG. 28 is a section view of major portions showing a state in which a lower layer of a main Au layer is formed according to one example of a method of manufacturing the thermal print head shown in FIG. 27.
Figure 29:
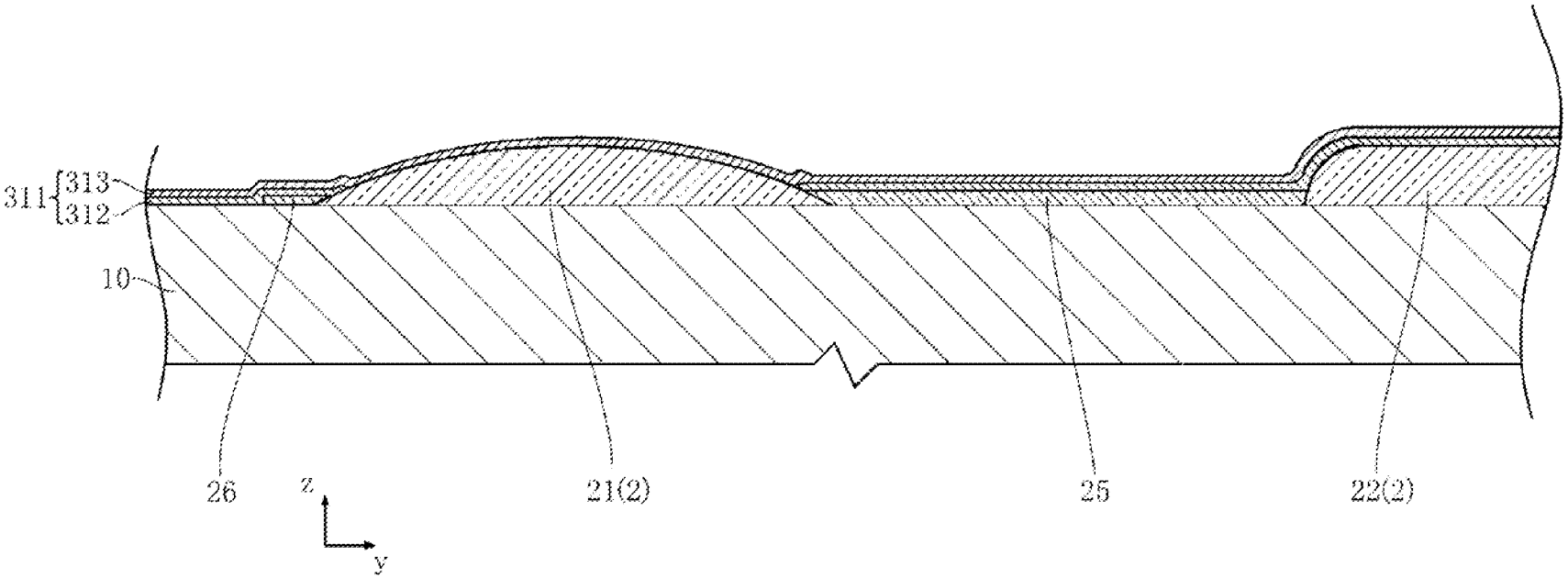
FIG. 29 is a section view of major portions showing a state in which an upper layer of the main Au layer is formed according to one example of the method of manufacturing the thermal print head shown in FIG. 27.

FIG. 27 shows a modified example of the thermal print head 101. The thermal print head 101 shown in FIG. 27 differs from the afore-mentioned thermal print head 101 in terms of the configuration of the electrode layer 3. In this modified example, the reduced thickness portion 322 is formed of the upper layer 303 of the main Au layer 301. The lower layer 302 is formed in a position deviating from the center of the heating resistor support portion 21 in the secondary scanning direction y.

Figure 30:
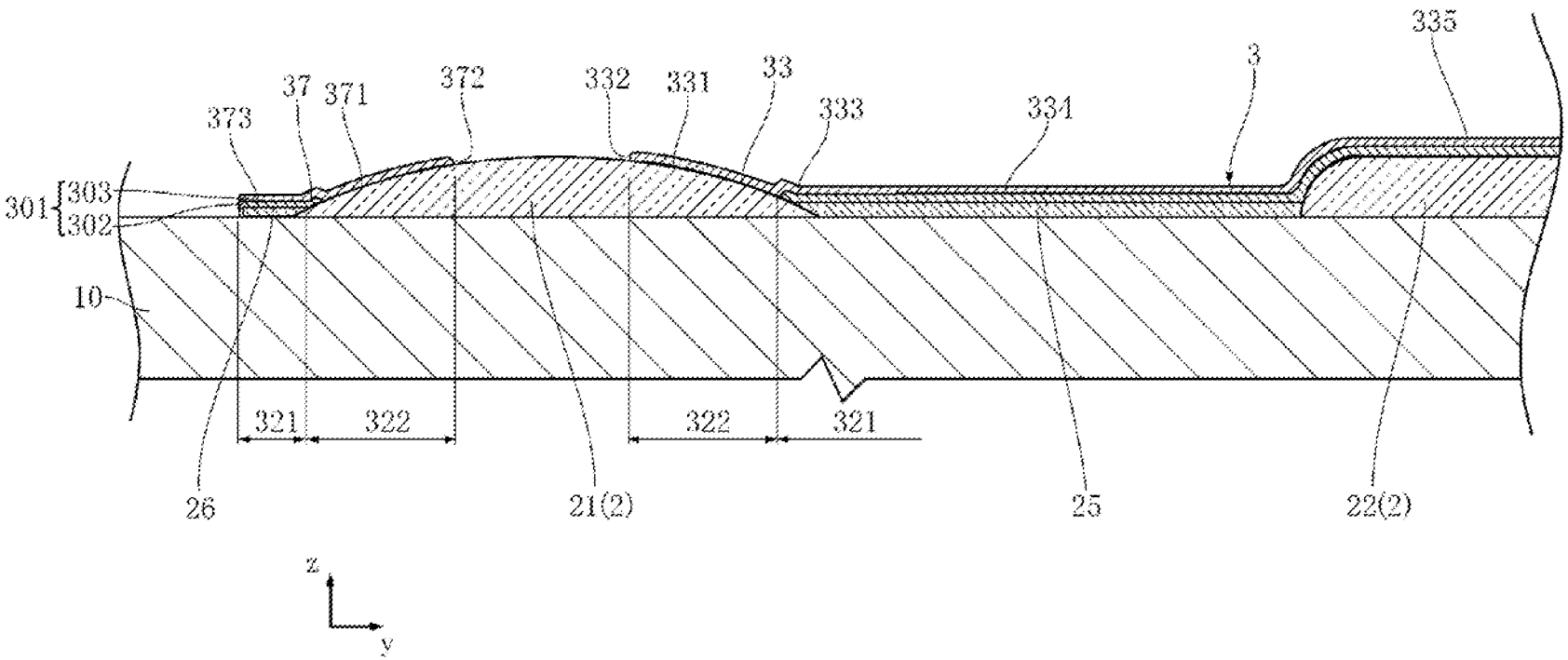
FIG. 30 is a section view of major portions showing a state in which the main Au layer and the auxiliary Au layer are etched according to one example of the method of manufacturing the thermal print head shown in FIG. 27.
Figure 31:
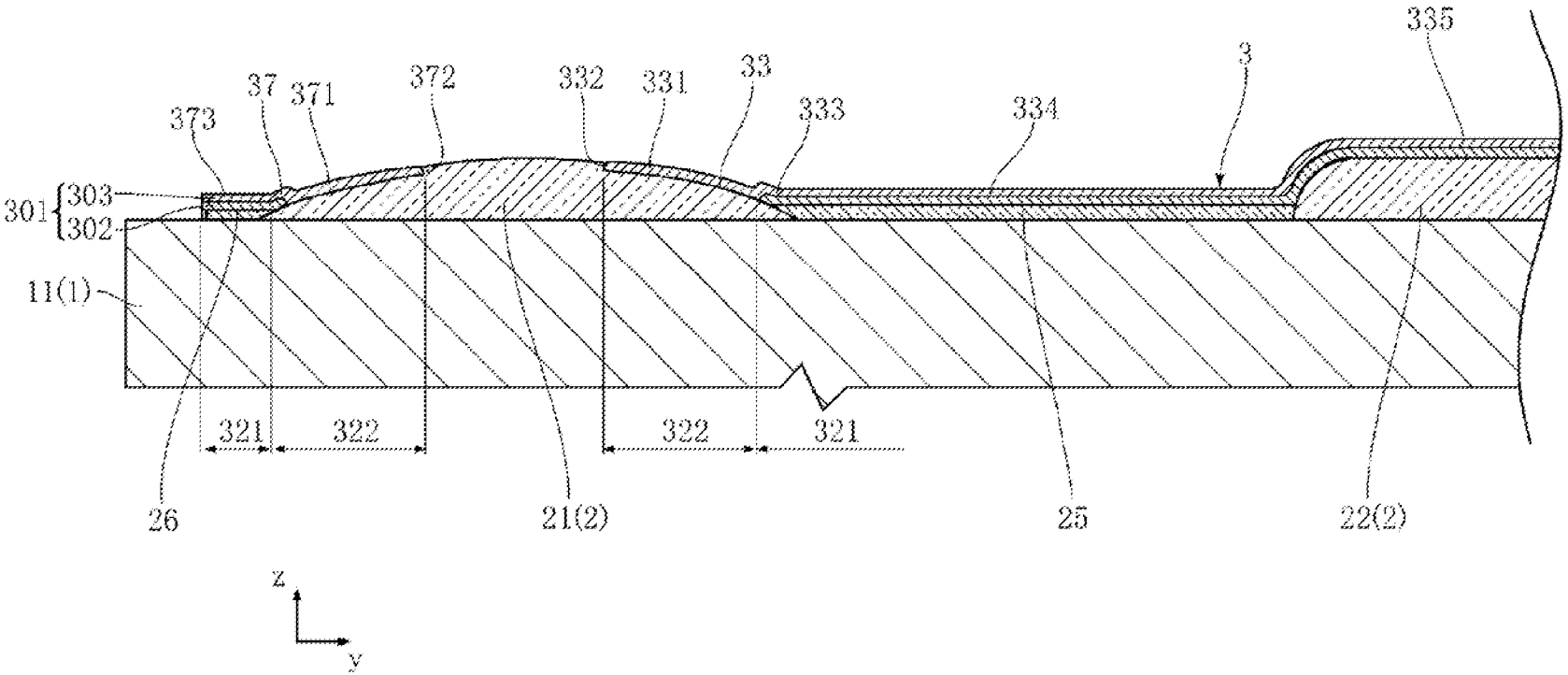
FIG. 31 is a section view of major portions showing a state in which a strip-shape portion is sunk according to one example of the method of manufacturing the thermal print head shown in FIG. 27.

FIGS. 28 through 31 show a modified example of the method of manufacturing the thermal print head 101. First, the glaze layer 2 and the glass layer 25 are formed on the ceramic substrate 10 and the lower layer 312 is formed subsequently. At this time, the lower layer 312 is formed so that the heating resistor support portion 21, can be exposed for the most part thereof. Then, the upper layer 313 is formed to cover substantially the entire surface of the ceramic substrate material 10. The auxiliary Au layer 334 is formed. The electrode layer 3 having the main Au layer 301 as shown in FIG. 31 is formed by subjecting the Au layer 30 to a sputtering process. The entire ceramic substrate material 10 is subjected to heating so that the tip end sections of the strip-shaped portions 331 and 371 can be sunk with respect to the heating resistor support portion 21 as shown in FIG. 30. Thereafter, the modified example of the thermal print head 101 is finally obtained through the processes described above with reference to FIGS. 19 through 26.

With this modified example, it is possible to prevent the electric resistance value of the electrode layer 3 from becoming unduly high, while restraining the resistor layer 4 from suffering from damage.

Figure 32:
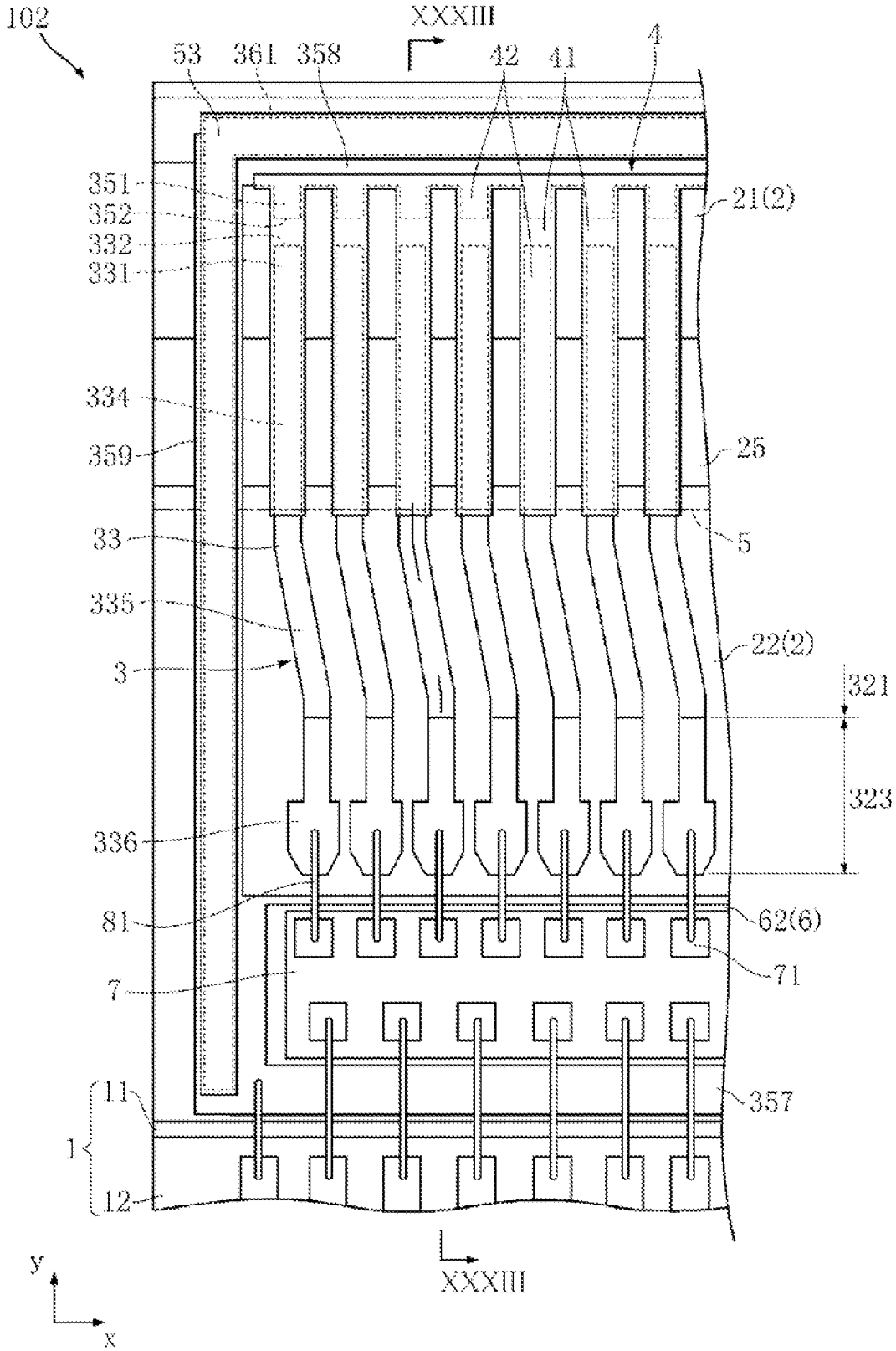
FIG. 32 is a plan view showing a thermal print head according to a second embodiment of the present disclosure.
Figure 33:
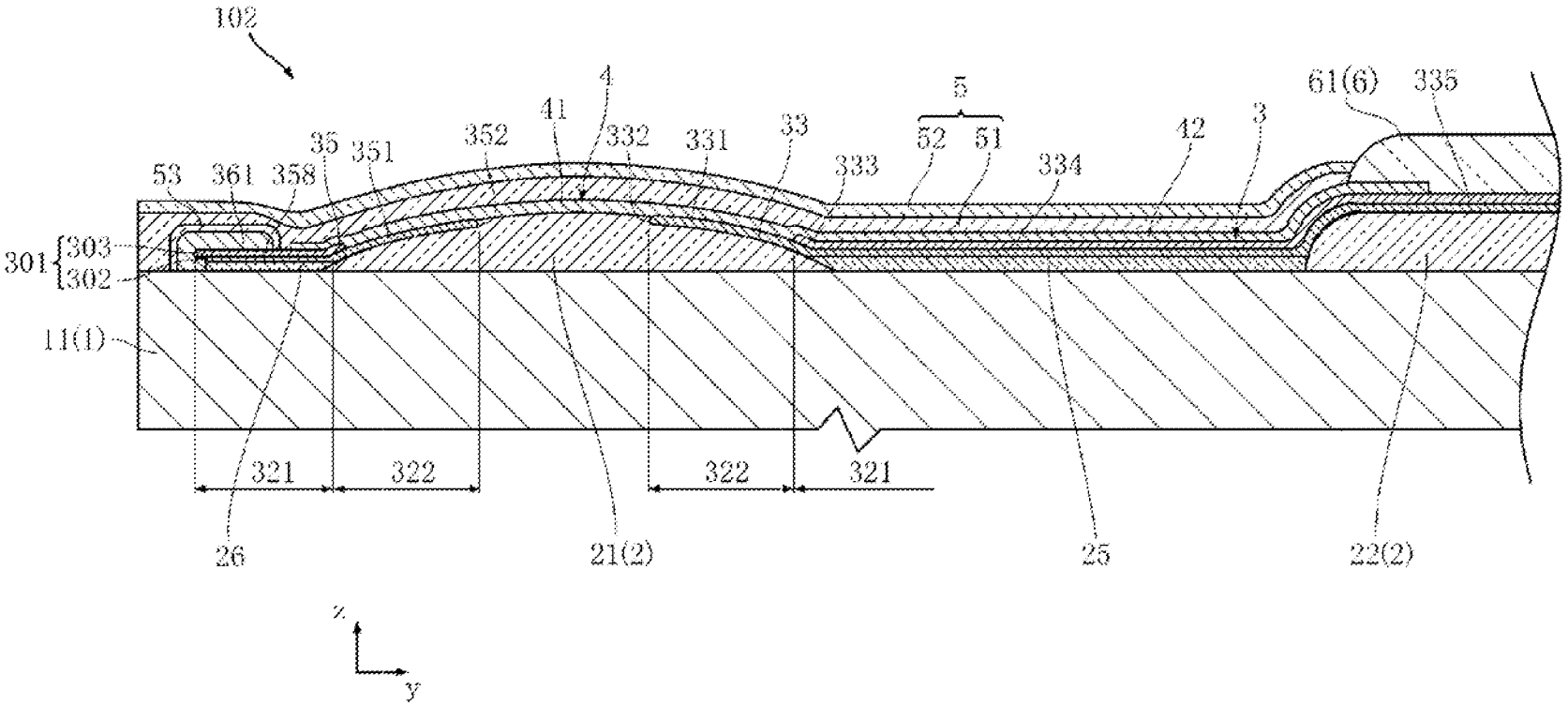
FIG. 33 is a section view taken along line XXXIII-XXXIII in FIG. 32.

FIGS. 32 and 33 show a thermal print head according to a second embodiment of the present embodiment. The thermal print head 102 of the present embodiment differs from the foregoing embodiment in terms of the configuration of the electrode layer 3 and in that the thermal print head 102 includes an Ag layer 361 and an Ag protective layer 53.

Referring to FIG. 32, the electrode layer 3 includes a plurality of individual electrodes 33 and a common electrode 35. The individual electrodes 33 are similar in configuration to the individual electrodes 33 of the thermal print head 101: The common electrode 35 includes a plurality of strip-shaped portions 351, a connecting portion 358, a detouring portion 359 and a base portion 357. The strip-shaped portions 351 extend in the secondary scanning direction y and are arranged along the primary scanning direction x. The opposing edges 352 of the strip-shaped portions 351 are located opposite the opposing edges 332 of the strip-shaped portions 331 of the individual electrodes 33. The connecting portion 358 is formed in one end area of the ceramic substrate 11 in the secondary scanning direction y and extends in the primary scanning direction x. The connecting portion 358 interconnects the plurality of the strip-shaped portions 351. The detouring portion 359 is formed in one end area of the ceramic substrate 11 in the primary scanning direction x to interconnect the connecting portion 358 and the base portion 357.

In the present embodiment, the strip-shaped portions 331 and 351 have a width of about 27.3 μm. The gap between the strip-shaped portions 331 and 351 in the primary scanning direction x is about 15 μm. The dimension of the bonding portion 336 in the primary scanning direction x is about 55 μm.

The Ag layer 361 has a strip shape and overlaps with the connecting portion 358 and the detouring portion 359 of the common electrode 35. The Ag layer 361 is made of Ag. The Ag layer 361 has a thickness of, e.g., about 16 μm.

The Ag protective layer 53 is provided to protect the Ag layer 361 and is formed into a strip shape to cover the entire Ag layer 361. The Ag protective layer s is made of, e.g., glass and has a thickness of about 4 to 10 μm.

Next, one example of a method of manufacturing the thermal print head 102 will be described with reference to FIGS. 34 through 36.

Figure 34:
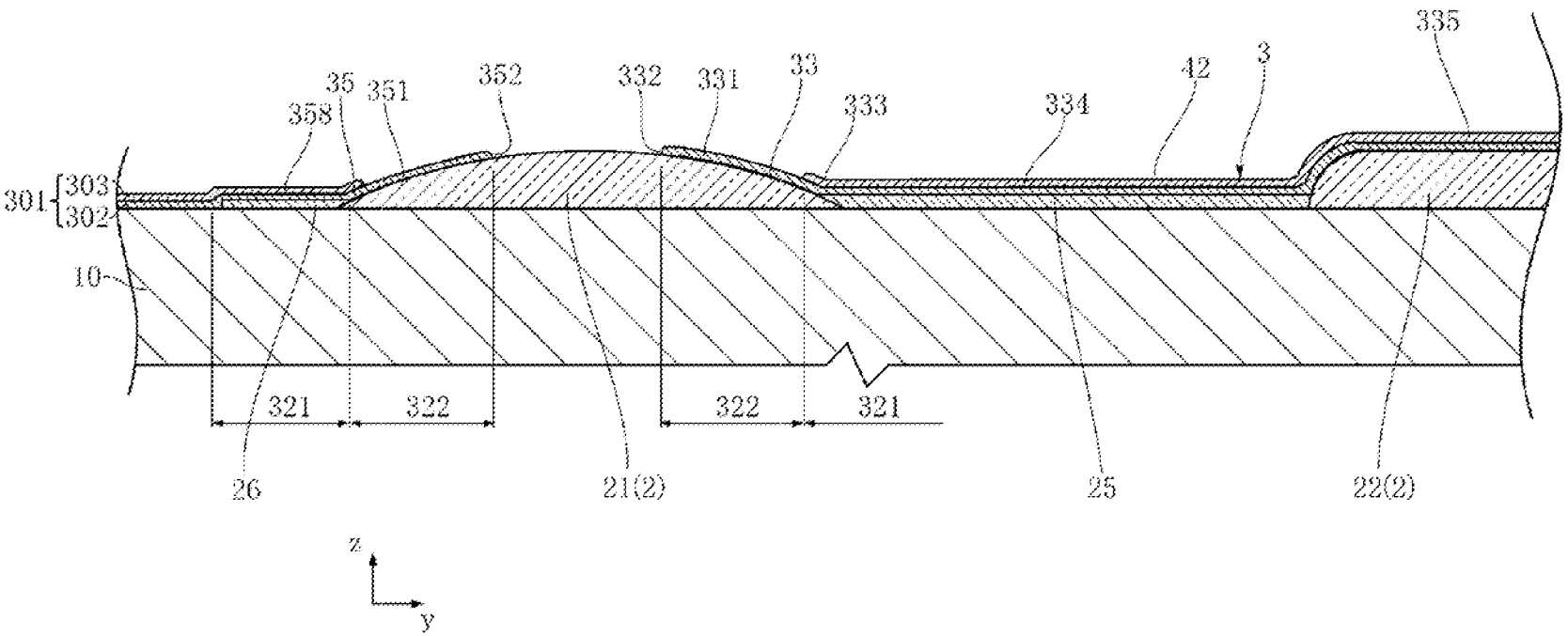
FIG. 34 is a section view of major portions showing a state in which a main Au layer and an auxiliary Au layer are etched according to one example of a method of manufacturing the thermal print head shown in FIG. 32.

As shown in FIG. 34, a glaze layer 2, glass layers 25 and 26 and an electrode layer 3 are first formed on a ceramic substrate material 10 through the processes similar to those described above with reference to FIGS. 6 through 17. In the state shown in FIG. 34, the strip-shaped portions 331 and 351 are not yet sunk with respect to the heating resistor support portion 21.

Figure 35:
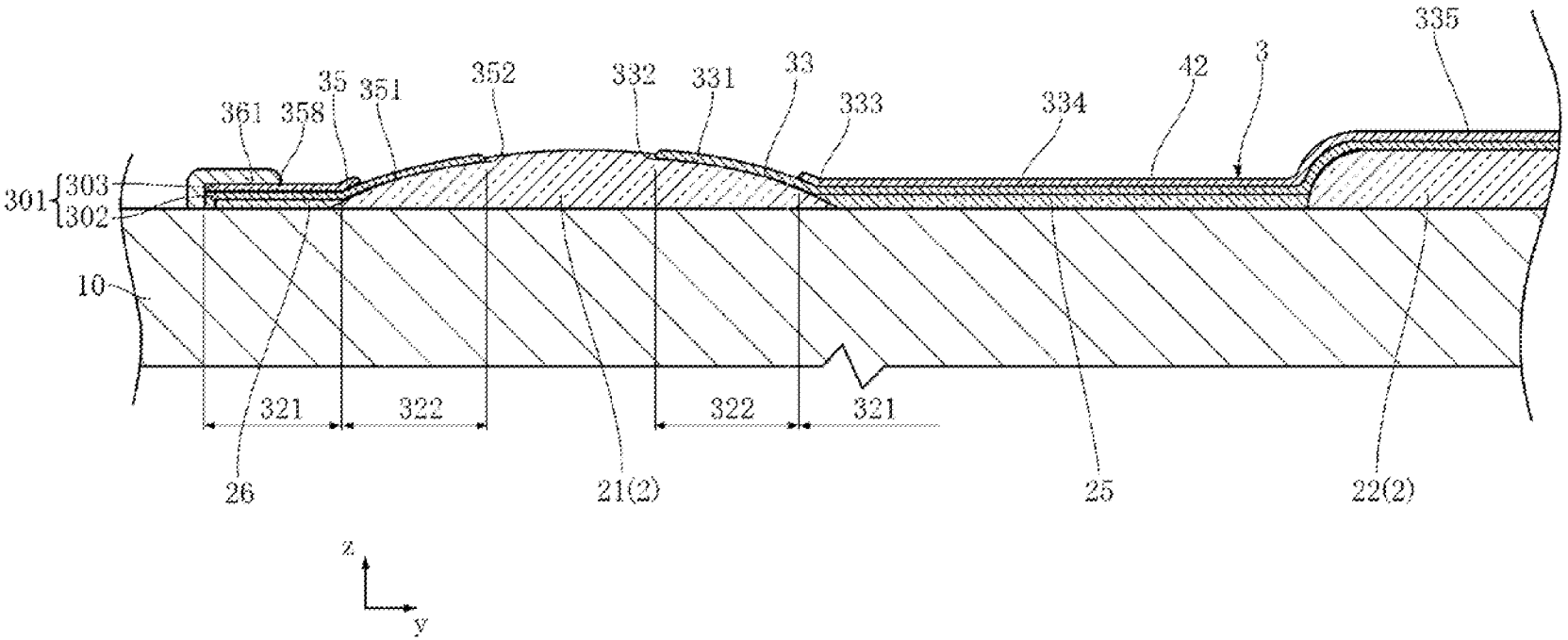
FIG. 35 is a section view of major portions showing a state in which an Ag layer is formed according to one example of the method of manufacturing the thermal print head shown in FIG. 32.
Figure 36:
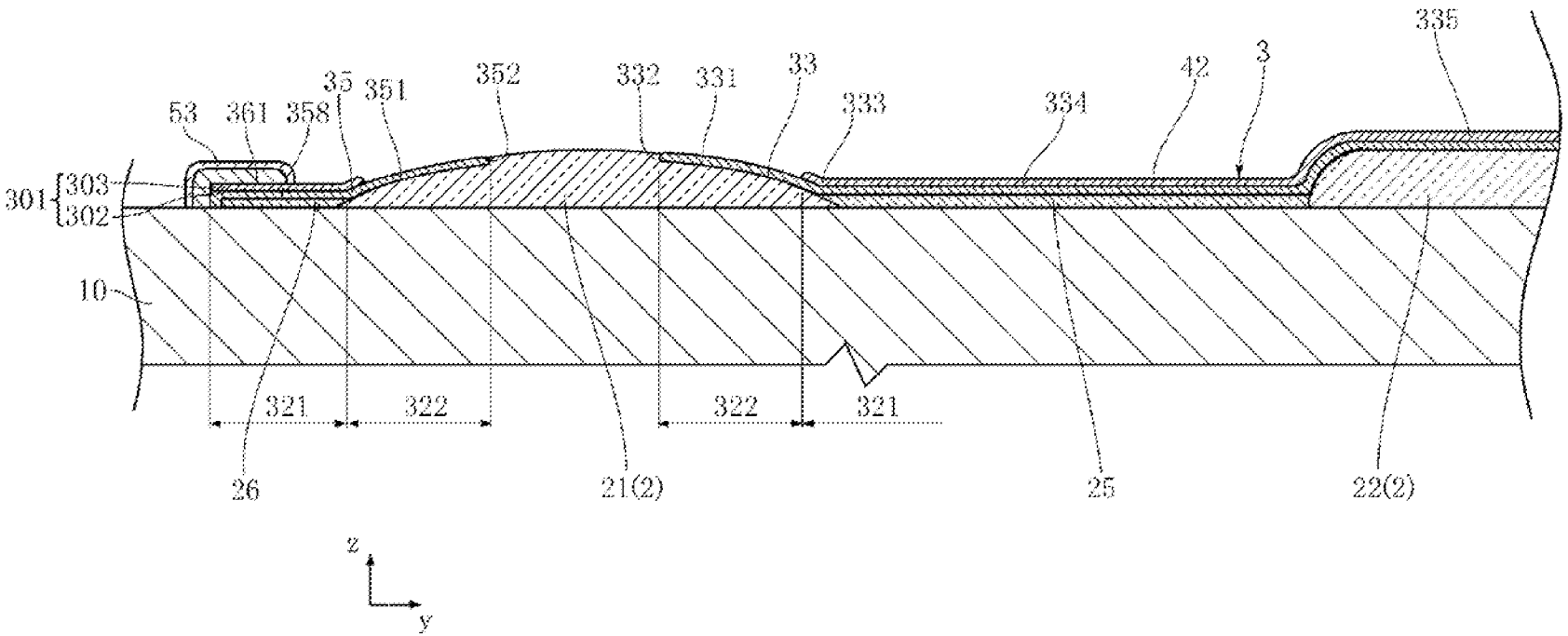
FIG. 36 is a section view of major portions showing a state in which an Ag protective layer is formed according to one example of the method of manufacturing the thermal print head shown in FIG. 32.
Figure 37:
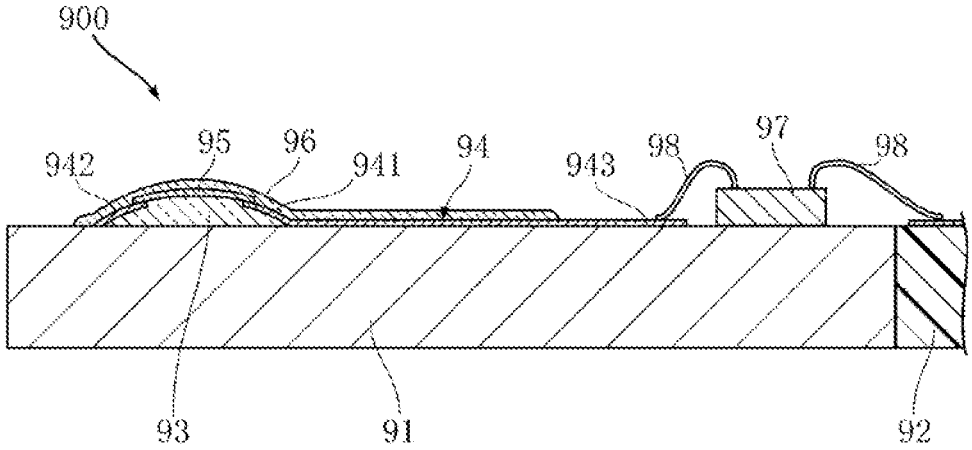
FIG. 37 is a section view of major portions illustrating one example of conventional thermal print heads.

Next, an Ag layer 361 is formed as shown in FIG. 35. The formation of the Ag layer 361 is performed by thick-film printing, e.g., paste containing Ag, and then sintering the paste thus printed. The heating resistor support portion 21 is heated in this sintering process, whereby the strip-shaped portions 331 and 351 are sunk with respect to the heating resistor support portion 21.

Next, an Ag protective layer 53 is formed. The formation of the Ag protective layer 53 is performed by printing, e.g., glass paste, and sintering the glass paste thus printed. The heating resistor support portion 21 is reheated in the sintering process, thereby accelerating the sinkage of the strip-shaped portions 331 and 351 with respect to the heating resistor support portion 21. Thereafter, the thermal print head 102 is finally obtained through the processes described above with reference to FIGS. 19 through 26.

With the present embodiment, an electric current flowing through the connecting portion 358 and the detouring portion 359 of the common electrode 35 also flows through the Ag layer 361. This makes it possible to reduce the electric resistance value of the common electrode 35. The Ag layer 361 is fully covered with the glass-made Ag protective layer 53. In the manufacturing process of the thermal print head 102, the entirety of the Ag layer 361 is kept covered by the Ag protective layer 53 when forming the resistor layer 40. Accordingly, it is possible to prevent the Ag layer 361 from being changed in property by a $CF_4$ gas or an $O_2$ gas generated when the resistor layer 40 is formed through the use of, e.g., a sputtering method or a CVD method.

Moreover, the manufacturing process of the Ag layer 361 and the Ag protective layer 53 can be combined with the process of sinking the tip end sections of the strip-shaped portions 331 and 351. This makes it possible to increase the manufacturing efficiency of the thermal print head 102.

The thermal print heads and the methods of manufacturing the same according to the present disclosure are not limited to the embodiments described above. The specific configurations thereof may be designed in many different ways.

While certain embodiments have been described, these embodiments have been presented by way of example only, and are not intended to limit the scope of the disclosures. Indeed, the novel thermal print heads and methods described herein may be embodied in a variety of other forms; furthermore, various omissions, substitutions and changes in the form of the embodiments described herein may be made without departing from the spirit of the disclosures. The accompanying claims and their equivalents are intended to cover such forms or modifications as would fall within the scope and spirit of the disclosures.

What is claimed is:

1. A thermal print head, comprising:

a substrate;

a glaze layer formed on the substrate and provided with a heating resistor support portion extending in a primary scanning direction and having an arc-like cross-sectional shape when seen in a direction perpendicular to the primary scanning direction;

an electrode layer including a plurality of individual electrodes, each provided with a first strip-shaped portion arranged along the primary scanning direction, each of the first strip-shaped portions formed on the heating resistor support portion, and a common electrode provided with a plurality of second strip-shaped portions arranged along the primary scanning direction, each of the second strip-shaped portions formed on the heating resistor support portion; and a resistor layer including heating portions heated by applying an electric current from the electrode layer and electrode covering portions each configured to cover a gap between the first and second strip-shaped portions, each of the first and second strip-shaped portions including a normal thickness portion and a reduced thickness portion thinner than the normal thickness portion, the reduced thickness portion positioned near the gap.

2. The thermal print head of claim 1, wherein the reduced thickness portion is sunk with respect to the heating resistor support portion.

3. The thermal print head of claim 1, wherein the electrode layer includes a main Au layer having a lower layer and an upper layer formed on the lower layer, the normal thickness portion formed of the lower layer and the upper layer, the reduced thickness portion formed of the lower layer.

4. The thermal print head of claim 1, wherein the electrode layer includes a main Au layer having a lower layer and an upper layer formed on the lower layer, the normal thickness portion formed of the lower layer and the upper layer, the reduced thickness portion formed of the upper layer.

5. The thermal print head of claim 1, wherein the electrode layer includes a plurality of relay electrodes electrically interposed between the plurality of the individual electrodes and the common electrode.

6. The thermal print head of claim 5, wherein each of the relay electrodes includes:

a pair of third strip-shaped portions arranged along the primary scanning direction, each of the third strip-shaped portions opposing the first and second strip-shaped portions with a gap and extending in a secondary scanning direction; and a connecting portion interconnecting two strip-shaped portions of the pair of third strip-shaped portions.

7. The thermal print head of claim 6, wherein the common electrode includes a branch portion joined to the two strip-shaped portions of the second strip-shaped portions.

8. The thermal print head of claim 1, wherein the common electrode includes a connecting portion interconnecting the second strip-shaped portions.

9. The thermal print head of claim 8, further comprising:

an Ag layer overlapping the connecting portion; and an Ag protective layer covering the Ag layer.

10. The thermal print head of claim 9, wherein the Ag protective layer is made of glass.

11. The thermal print head of claim 1, further comprising:

a drive IC selectively providing the electric current to the resistor layer.

12. The thermal print head of claim 11, wherein the common electrode includes a base portion spaced apart from the heating resistor support portion farther than the individual electrodes in a secondary scanning direction, the base portion configured to support the drive IC for selectively applying the electric current to the individual electrodes.

13. The thermal print head of claim 12, further comprising:

a resin layer interposed between the drive IC and the base portion.

14. The thermal print head of claim 1, wherein the substrate is made of ceramic.

15. The thermal print head of claim 13, further comprising:

a heat radiating plate made of metal and attached to the substrate.

16. A method of manufacturing a thermal print head, comprising:

forming a glaze layer on a substrate, the glaze layer provided with a heating resistor support portion extending in a primary scanning direction and having an arc-like cross-sectional shape when seen in a direction perpendicular to the primary scanning direction;

forming an electrode layer including a plurality of individual electrodes, each provided with first strip-shaped portions arranged along the primary scanning direction, each of the first strip-shaped portions formed on the heating resistor support portion and a common electrode provided with a plurality of second strip-shaped portions arranged along the primary scanning direction, each of the second strip-shaped portions formed on the heating resistor support portion; and forming a resistor layer including heating portions heated by applying an electric current from the electrode layer and electrode covering portions each configured to cover a gap between each of the first and second strip-shaped portions, each of the first and second strip-shaped portions being formed, when forming the electrode layer, to include a normal thickness portion and a reduced thickness portion thinner than the normal thickness portion, the reduced thickness portion positioned near the gap.

17. The method of claim 16, further comprising:

after forming the electrode layer and before forming the resistor layer, sinking the reduced thickness portion with respect to the heating resistor support portion by heating the heating resistor support portion.

18. The method of claim 16, wherein the forming the electrode layer includes forming a main Au layer having a lower layer and an upper layer formed on the lower layer, the normal thickness portion formed of the lower layer and the upper layer, the reduced thickness portion formed of the lower layer.

19. The method of claim 16, wherein forming the electrode layer includes forming a main Au layer having a lower layer and an upper layer formed on the lower layer, the normal thickness portion formed of the lower layer and the upper layer, the reduced thickness portion formed of the upper layer.

20. The method of claim 16, wherein forming the electrode layer includes printing paste containing Au and then sintering the paste.

21. The method of claim 16, wherein forming the resistor layer is performed by a sputtering method or a CVD method.

22. The method of claim 16, wherein forming the electrode layer includes forming the common electrode having a connecting portion interconnecting the second strip-shaped portions, and further comprising: after forming the electrode layer and before forming the resistor layer, forming an Ag layer by printing Ag paste to overlap with the connecting portion and then sintering the Ag paste; and, after forming the Ag layer and before forming the resistor layer, forming an Ag protective layer by printing glass paste to cover the Ag layer and then sintering the glass paste.

23. The method of claim 22, wherein at least one of sintering the Ag paste and sintering the glass paste is combined with sinking the strip-shaped portions with respect to the heating resistor support portion.

* * * * *